US005518574A

United States Patent [19]

Yates et al.

[11] Patent Number: 5,518,574

[45] Date of Patent: May 21, 1996

[54] FORM FOLDING AND GLUING MACHINE

[75] Inventors: Donald E. Yates, Garden Grove; Robert S. Knusdsen, Los Altos Hills, both of Calif.

[73] Assignee: Glue-Fold, Inc, Newark, Calif.

[21] Appl. No.: 236,651

[22] Filed: Apr. 29, 1994

Related U.S. Application Data

[63] Continuation-in-part of Ser. No. 862,001, Apr. 1, 1992, abandoned.

[51] Int. Cl.[6] ..... B05B 12/00

[52] U.S. Cl. ..... 156/356; 156/389; 156/442.1; 156/442.2; 271/112; 271/184; 271/225

[58] Field of Search ..... 118/70, 429; 156/356, 156/364, 389, 441.5, 442.1, 442.2, 578; 222/82, 83; 229/92, 92.1, 92.3; 271/112, 184, 185, 225, 248, 250

[56] References Cited

U.S. PATENT DOCUMENTS

| | | | |
|---|---|---|---|
| 3,208,639 | 9/1965 | Marwell et al. | 222/82 |
| 3,374,927 | 3/1968 | Schmidt | 222/82 |
| 4,042,235 | 8/1977 | Wanner et al. | 271/112 |
| 4,269,405 | 5/1981 | Mitzel | 271/112 |
| 4,406,247 | 9/1983 | Baughman et al. | 156/356 X |
| 4,501,383 | 2/1985 | Iannelli | 222/82 |
| 4,678,101 | 7/1987 | Nitchman et al. | 222/82 |
| 4,951,864 | 8/1990 | Dicker | 229/92.3 |
| 5,048,809 | 9/1991 | Tebbe et al. | 156/364 |
| 5,056,772 | 10/1991 | Kellum, III | 271/184 |
| 5,114,033 | 5/1992 | Golias et al. | 222/82 |
| 5,114,137 | 5/1992 | Olson | 271/184 |
| 5,183,252 | 2/1993 | Wolber et al. | 271/196 |
| 5,192,389 | 3/1993 | Martin | 156/442.1 |
| 5,194,114 | 3/1993 | Walter | 156/442.1 |
| 5,196,083 | 3/1993 | Baker et al. | 156/442.2 |

*Primary Examiner*—David A. Simmons
*Assistant Examiner*—Paul M. Rivard
*Attorney, Agent, or Firm*—Donald R. Boys

[57] ABSTRACT

A self-mailer machine for producing self-adhered mailers from single sheets has improved vacuum feed for high operating speed and larger batch loading than has been previously available. The machine also has an improved glue reservoir system wherein glue is provided in sealed containers to be punctured at the time of loading the glue to the reservoir. Optional features are a forms compactor to keep glued forms together until glue sets, and a rotator/perforator for rotating forms at high speed to perforate lines at a right angle to previously perforated lines.

8 Claims, 20 Drawing Sheets

FORM FOLDING AND GLUING MACHINE

This is a continuation-in-part of application Ser. No. 07/862,001, filed Apr. 1, 1992, now abandoned.

FIELD OF THE INVENTION

The present invention is in the area of apparatus and methods for gluing and folding forms, and pertains more specifically to such machines for making self-mailers from single sheets.

BACKGROUND OF THE INVENTION

In commercial operations where very large numbers of similar documents must be produced and mailed, a very small savings per document will translate into a large saving over the many documents. Examples of such documents are payroll checks, direct mail solicitations, 1099 forms, invoices, business statements, coupons, sales pieces, student grade reports, membership notices, and so forth. There are many other examples.

Traditional expenses for such operations include the cost of printing the documents, and labor for such tasks as folding, stuffing envelopes, and addressing.

In recent years, especially with the rapid growth of computer control techniques, equipment has been developed to produce self-mailers from single sheets. This process takes a single sheet and folds it in concert with an application of adhesive (or activation of existing areas of adhesive), perforates the edges for ease of opening, and seals the sheet into a unit known in the art as a self-mailer. The self-mailer becomes its own envelope, and no stuffing of envelopes is needed.

There are a number of different types of self-mailers known in the art and a number of different procedures for making them. For example, a type of adhesive that may later be activated with water may be applied to single sheets, which are then fed automatically through a laser printer, and then to a self-mailer machine that moistens the adhesive strips, folds the sheets, perforates the sheets appropriately for the particular form, and seals the unit together as a self-mailer. This kind of adhesive is the type used for flaps of most envelopes, and thus is familiar to most everyone.

The moistenable adhesive approach is used by manufacturers who judge it too difficult and troublesome to apply adhesive at the self-mailer machine; and if not done properly, applying glue at the self-mailer machine can be truly troublesome.

The pre-gluing approach, however, has its own drawbacks. For example, applying moistenable adhesive to the single sheets cannot normally be done in concert with printing, because the adhesive must be allowed to cure before coming in contact with the printing equipment or even other single sheets. Moreover, even cured, the moistenable adhesive is often not compatible with printing equipment, especially laser printers which operate by applying a high local temperature to the paper upon which printing is to be done. The high temperature often softens the adhesive and renders it tacky, creating jams and cleaning problems. Further, moistening the adhesive in the self-mailer machine can be just as troublesome as applying adhesive, because water can get onto regions where it isn't wanted and can also damage the equipment.

The approach of moistenable adhesive to avoid applying adhesive at the self-mailer machine is often, therefore, more expensive than the problems it is meant to avoid. The application of the moistenable adhesive is a separate operation with its own attendant costs, the problems the adhesive causes in printing equipment, particularly laser printing equipment, slows down the printing operation making it more expensive, and no balancing savings is realized at the self-mailer machine.

Still, until the present invention, the serious problems of applying adhesive directly at the self-mailer machine have never been adequately addressed. These problems include controlling glue "guns" to start and stop in concert with machine speed to put the adhesive just where it is wanted, applying the adhesive at rates allowing maximum operating speeds so the speed of operations is not limited by the adhesive application, avoiding plugging of applicators between runs, cleaning of the equipment, and loading new supplies of adhesive.

Another issue is the kind of glue to be applied. There are a number of different kinds of glue, including "hot melt" types, which solidify and adhere on cooling, and "cold" glue, which generally reacts with air to dry. Hot melt glue is notoriously difficult to apply at high speed, and also messy and problematic when it comes time to clean equipment.

Another difficulty with self-mailer machines is in the fact that single sheets used for the mailers and fed to the self-mailer machine are not always cut exactly square, and out of squareness can interfere with feeding of the sheets, which is done at rates of 20,000 per hour and higher. High speed is, of course, very desirable.

Yet another difficulty is in the periodic maintenance required for such machines, particularly those that feed adhesive at the self-mailer machine. The adhesive can be difficult to handle and messy, and can cure to stop up feeders. Moreover, adding new adhesive is a real problem with most machines.

Still another difficulty is that self mailers produced by a machine tend to open up before the adhesive is fully cured after the self-mailer leaves the machine that produces it. This problem has never been adequately addressed in the art.

Still another problem is that it is often desirable to perforate sheets and mailers in several different lines. It may be desirable, for example, to perforate a self-mailer along the short edges in "perf" lines that are in the direction that the mailer passes through the self-mailer machine. "Perf" lines of this sort are the familiar perforations at the "ends" of an envelope formed as a self-mailer. It may be desirable, however, to make one or more "perf" lines across the width of a mailer at right angles to the "perf" lines at the ends of the envelope. This operation generally requires either rotating the self-mailer ninety degrees in the self-mailer machine, or gathering the self-mailers as they exit the machine and sending them through another machine.

What is needed is a self-mailer machine with a subsystem for applying adhesive, preferably cold adhesive, in a manner that allows high operating speed while providing for adjustment to keep the adhesive where it is wanted. The adhesive system must allow for periodic stoppage to reload forms, change operations, and so forth, without danger of plugging adhesive applicators, and also must allow for reloading adhesive without extensive downtime for cleaning such as glue-pots and applicators. Applying adhesive directly at the self-mailer machine avoids all of the problems of application of adhesive prior to the self-mailer machine, and, properly done, provides for the fastest and least costly means of making self-mailers.

The machine also needs to have a means for insuring that self-mailers made on the machine stay folded and sealed until the glue sets up or cures to a sufficient extent to keep the self-mailer together. To add utility, the self-mailer machine needed also should have a means for turning self-mailers in process by about ninety degrees, and adding perforation lines at right angles to the original direction of travel through the self-mailer machine.

SUMMARY OF THE INVENTION

In a preferred embodiment of the present invention an apparatus for producing self mailers is provided comprising a feeding and folding system for feeding sheets from a stack and folding the sheets to produce self-mailers. The apparatus comprises a gluing system disposed along the path of sheets in the folding system for applying glue to the sheets so they will adhere to produce self-mailers, and the gluing system has a pressurized glue reservoir. The apparatus includes in a preferred embodiment a microprocessor-based control system for managing operations and for providing an operator interface for entering control variables and displaying information. Sheets are fed into the self-mailer machine by a vacuum device making contact with a sheet to be fed, and the area of contact is at least 250 square millimeters.

The vacuum device for feeding sheets can be a linear translator or one or more vacuum wheels. In a preferred embodiment the vacuum device is a wheel with radial vacuum passages arranged in a row parallel to the rotary axis of the wheel. Also in a preferred embodiment glue is furnished for the machine in a sealed glue bucket having a perforatable seal in the top of the bucket. In this embodiment, a stem on the lid of the reservoir punctures the perforatable seal when a bucket of glue is loaded.

The apparatus of the present invention, having vacuum area in contact with a sheet to be fed of at least 250 square millimeters, is capable of feeding sheets from the bottom of a stack equal to a ream of sheets, and at a rate of up to 30,000 sheets per hour. Moreover, by furnishing glue in sealed containers with a perforatable seal, the inside of the glue reservoir is protected, and need not be cleaned as it would have to be if it held the glue directly. The provision of glue guns in removable modules with flexible connectors also allows guns to be moved and placed in cleaning trays for purging and cleaning, which is a considerable advantage at service intervals.

In an embodiment of the present invention, the self-mailer machine has a compacting system for holding folded and glued self-mailers together for a time long enough for the glue to cure so the self-mailers produced do not reopen. The machine of the invention also needs to have a system for making perforations both across the width and along the length of a self-mailer produced.

DESCRIPTION OF THE PREFERRED EMBODIMENTS

General Description

Figure 1:
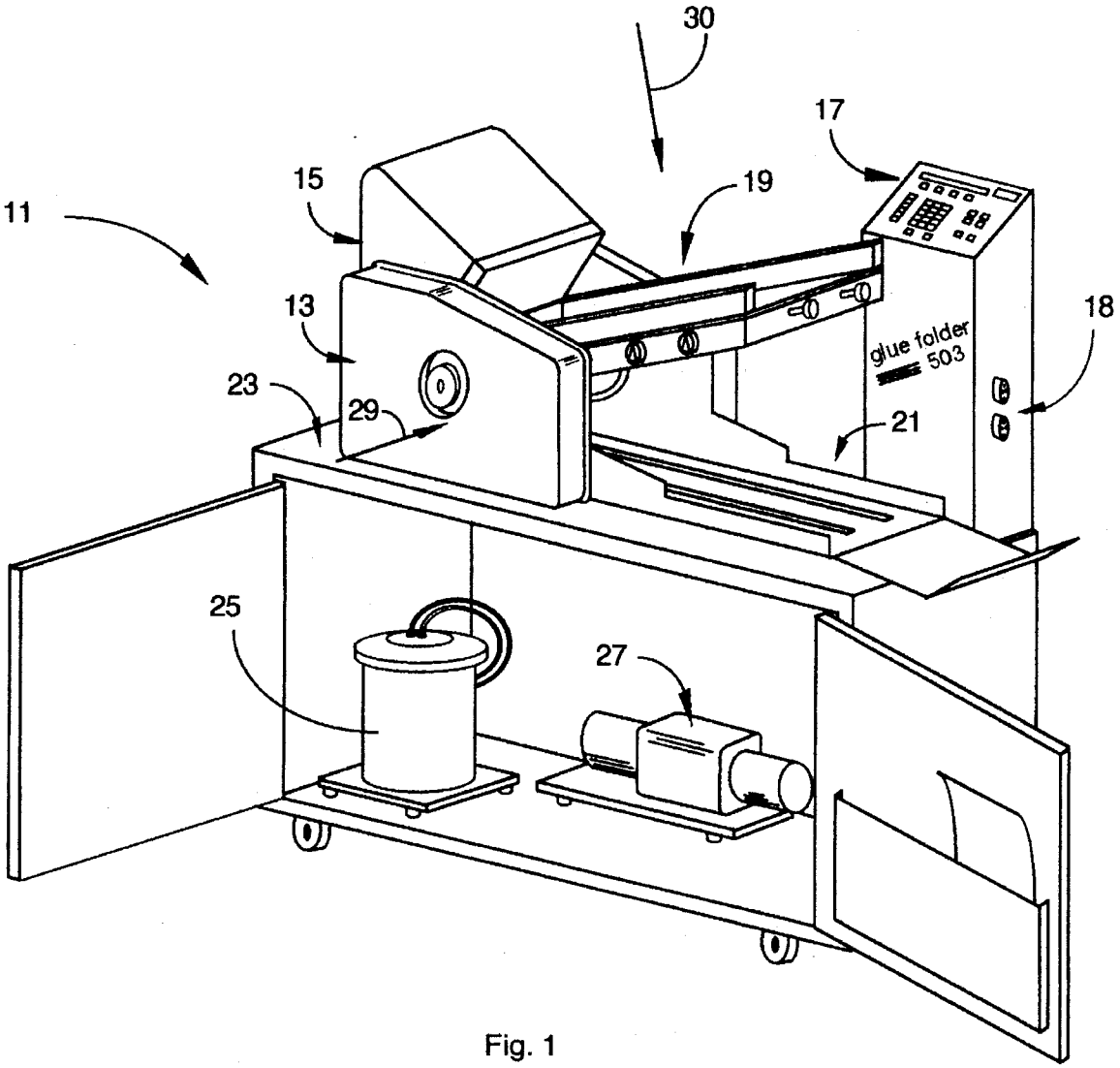
FIG. 1 is an isometric view of a self-mailer machine according to an embodiment of the present invention.

FIG. 1 is an elevation view of a self-mailer machine 11 according to a preferred embodiment of the present invention, which in this specification is called the Glue-Folder Model 503 machine. The Glue-Folder 503 machine is a combination of a high-speed folder 13; an advanced, electronically-controlled gluing subsystem 15, which includes a system for feeding glue from a glue pot under pressure; perforators (not shown in FIG. 1); a microprocessor-based control subsystem 17, which includes double-sheet detection and jam protection; and conventional electrical power components. Connectors 18, which may be placed as shown or elsewhere on the cabinetry or frame of the machine, are for power and control connections between control sub-system 17 and optional equipment which may be added to the machine shown in FIG. 1.

The Glue-Folder 503 also comprises a sheet feeding sub-system 19 which features adjustment for sheet squareness and a vacuum feed wheel for maximizing high-speed performance. Finished self-mailers exit on a conveyor 21 which may be interfaced with other equipment, or mailers may be removed from the conveyor periodically as they accumulate. In an embodiment of the invention a compacting conveyor not shown in FIG. 1, but described further below, is added to the basic machine as an option. In another option also not shown in FIG. 1, but described in detail below, apparatus is provided to be placed at the exit of the unit shown in FIG. 1, to rotate self-mailers exiting the machine, and to add one or more perforation lines which will be at a right angle to perforation lines made previously.

The Glue-Folder 503 machine in the preferred embodiment assembles to a support cabinet 23 which serves to present the apparatus at a convenient height and to house peripheral equipment such as a pressurized glue reservoir 25 and vacuum pump and compressor equipment 27. Equipment shown in cabinet 23 in FIG. 1 is intended to be representational rather than detailed. There are many other ways than those shown that the equipment may be arranged.

A central part of the Glue-Folder 503 machine is the sheet feeder and folder, comprising elements 13 and 19 (FIG. 1). The feeder and folder in the preferred embodiment is a feeder and folder combination made from the Elite 500 Super VF, which is a product of Pro-Fold Corporation of Sebastian, Florida. The Pro-Fold company alters the standard product in specific ways at the instruction of, and to meet the requirements of the inventors.

The feeder/folder is capable of speeds of from 25,000 to 30,000 sheets per hour (sph), using 8.5×11 standard size sheets, with a full ream of sheets loaded in the feeder tray. Sheet stock may be from 13# bond to 70# coated stock. These features are a result of unique characteristics of the Elite 500 Super VF feeder/folder and the alterations made for the inventors, which are more fully described below.

Feeder/Folder

Figure 2:
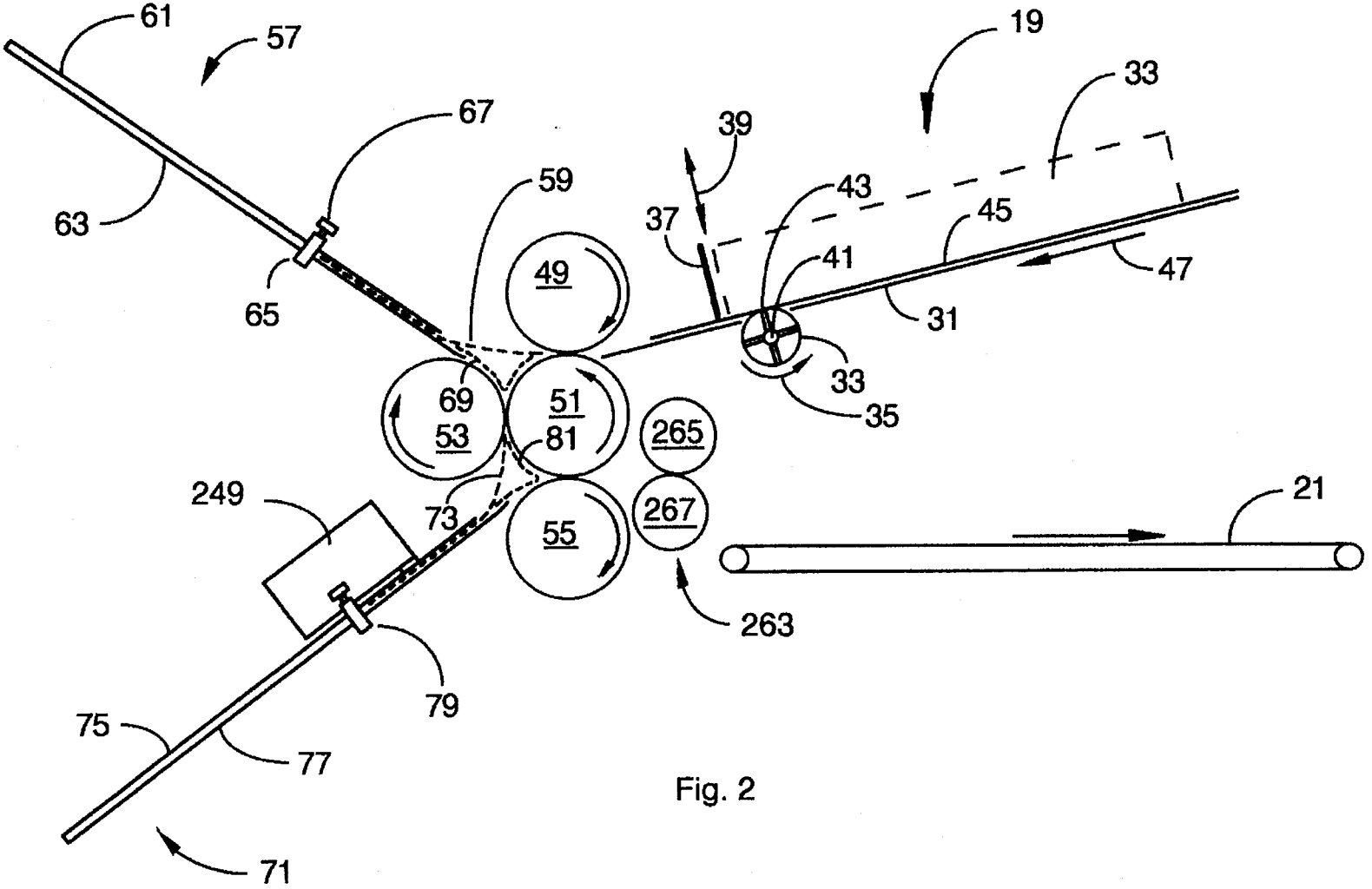
FIG. 2 is a largely schematic illustration of the arrangement of a feed tray, rollers, and folding plates for a feeder/folder according to the invention.

FIG. 2 is a side elevation mostly schematic view showing the roller arrangement of the Elite 500 feeder/folder and some other elements of the self-mailer machine of the present invention. This view is in the general direction of arrow 29 in FIG. 1. Many of the frame members of the machine are not shown in FIG. 2 to avoid confusion and better illustrate the elements that directly effect feeding and folding forms.

Sheet feeding sub-system 19 indicated in FIG. 1 and FIG. 2 comprises a tray for holding a stack of sheets to be converted to self mailers. The tray is shown in FIG. 2 as a simple base plate 31, but actually comprises sides and adjusting apparatus to be described below for insuring that sheets that are not square are fed properly, among other reasons. A stack of sheets to be fed is indicated in FIG. 2 by area 33 enclosed by dotted lines.

A vacuum operated feed wheel 33 extends through tray 31 in sheet-feeding sub-system 19 and is operated by a conventional motor drive (not shown) in the rotary direction of arrow 35. An adjustable paper stop 37 can be adjusted in the direction of arrow 39 to provide a gap with tray 31 so only a single sheet may be fed under the stop from stack 33 in the direction of arrow 47. Feed wheel 33 has passages from a center manifold 41 (passage 43 is exemplary), and is designed so only those passages facing the sheet stack are fed by vacuum as the feed wheel rotates. As passages, such as passage 43, contact sheet 45, which is the bottom sheet of the stack on tray 31, and feed wheel 33 continues to rotate bringing other vacuum passages into contact with sheet 45, sheet 45 is fed under paper stop 37. There are low-pressure air blowing passages (not shown) along the sides of tray 31 and a manifold (also not shown) near stop 37 to aid in separating sheets so only the bottom sheet feeds.

Sheet 45 is fed in the direction of arrow 47 until the leading edge of the sheet is engaged between rollers 49 and 51. Rollers 49 and 51 each turn in the direction of the arrows shown on the respective rollers, so the sheet engaged in the rollers is fed through the rollers (pulled from the bottom of the stack) toward an upper folding plate 57, which has upper and lower guide plates 61 and 63 respectively. Sheet 45 proceeds approximately along dotted line 59 and enters folding plate 57 between guide plates 61 and 63.

As the fed sheet proceeds upward between plates 61 and 63, it encounters a stop 65 which is adjustable in position along the length of the folding plate, and secured by conventional means such as a clamp screw 67, At the time that sheet 45 encounters stop 65, it is still engaged by rollers 49 and 51. The sheet can feed no further between plates 61 and 63, and continues to be fed, so the sheet folds down as shown approximately by dotted line 69, and is caught between rollers 51 and 53.

By being fed then down through rollers 51 and 53 a first fold is accomplished. The sheet then proceeds, folded edge leading, into a lower folder plate 71 along approximately line 73. Lower folding plate 71 comprises an upper and a lower guide plate 75 and 77, and an adjustable stop 79 similar to stop 65 on upper folding plate 57. The leading edge of the folded sheet, now engaged between rollers 49 and 51, and also between rollers 51 and 53, encounters stop 79, can proceed no further, and is subsequently bent along approximately line 81 until the sheet is caught and engaged between rollers 51 and 55. This action accomplishes a second fold, so there are then three distinct flat sections, just as one typically folds a sheet for insertion into an envelope. Stops 67 and 79 may be adjusted at a wide variety of positions to change the position in the length of a sheet where the folds are made.

The folded sheet proceed between rollers 51 and 55 and is deposited onto conveyor 21 to be conducted away from the Feeder. The linear speed of the conveyor is relatively slow so a large number of folded sheets may be held on the conveyor as it moves.

The above discussion is meant to describe the folding action, but not the gluing and perforation, which is described in more detail below, The actual output onto conveyor 21 from the self-mailer machine of the present invention is completed self-mailers rather than just folded sheets.

Rollers 49, 51, 53, and 55 span substantially the width of high-speed folder 13, and are driven in unison by conventional gears from a single drive motor through one of the sides of the folder. The rollers may also be rotated manually in unison by turning knob 12 (FIG. 1), which is useful in setup and adjustment procedures.

It will be apparent to one with skill in the art that a guide might be installed between where a folded sheet exits from rollers 51 and 53 to guide the sheet directly into engagement by rollers 51 and 55, so a single fold is made. In this case the lower folder plate is not needed. The position of stop 67 may also be adjusted to adjust the position of the single fold relative to an unfolded sheet. It will be apparent as well that the apparatus may also be arranged to use only the lower folding plate, and a wide variety of folds may be accomplished by such alterations and combination thereof.

Figure 3:
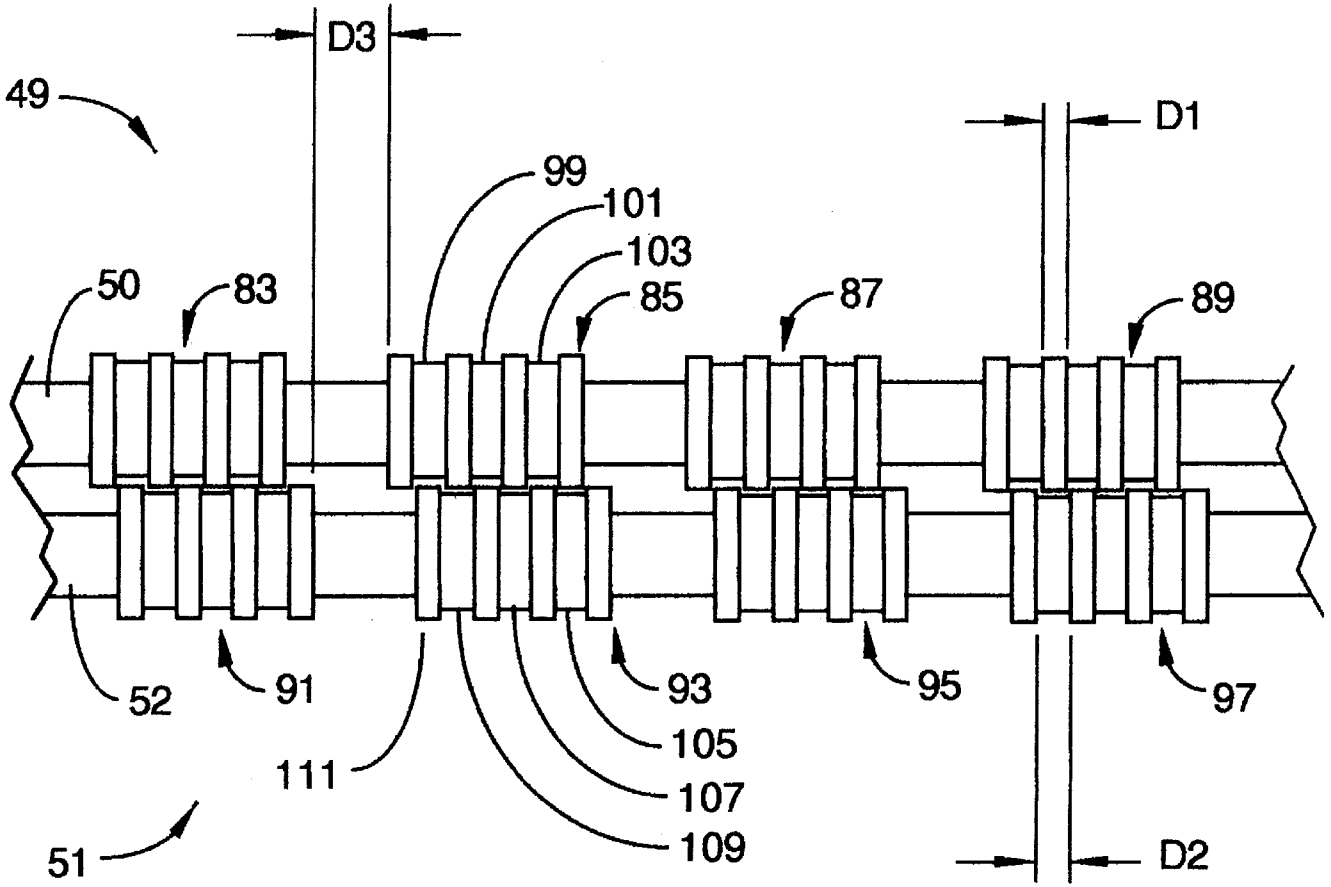
FIG. 3 is a view of two exemplary feed rollers for the self-mailer of the invention.

FIG. 3 shows the nature of the feed rollers in the high-speed folder, viewing at a right angle to the view of FIG. 2, and showing parts of roller 49 and roller 51 as an example of the engagement of the rollers with one another. Rollers 49 and 51 shown have metal shafts 50 and 52 respectively, and outer covers in discrete lengths, made of flexible material such as rubber or polyurethane. The metal shafts could also be made of other substantially rigid materials, such as molded plastics.

In FIG. 3 shaft 50 of roller 49 has flexible outer covers 83, 85, 87, and 89, and shaft 52 of roller 51 has outer covers 91, 93, 95, and 97.

The covers are preferentially made with circumferential grooves such as grooves 99, 101, and 103 of cover 85, and grooves 105, 107, and 109 of cover 93. The covers are typically offset in position along the roller axis direction so a groove in one roller matches with the area between two grooves on another on an engaging roller. For example, groove 99 on outer cover 85 of roller 49 matches with raised land 111 on outer cover 93 of roller 51. Also, the land width between grooves (D1) is less than the width of a groove (D2), so there may be a slight overlap of the outer circumferences of two engaging rollers without physical interference. This feature is common to all of the outer covers shown.

The outer covers used on rollers may be adjusted in position along the axis direction of a roller, so the number of outer covers and the space between them on a single roller may be adjusted. In this manner there may be regions where a linear width of a sheet fed between the rollers will not be contacted by the rollers, because there is no outer cover on either roller in that region. The region shown with dimension D3 is an example of such a region.

Strip regions of no contact are very useful for protecting regions of forms that should not be contacted. As an example, there are strips along usually the outer edges of sheets where the self-mailer machine applies glue, and these must not be contacted by the rollers during feeding and folding. It will be apparent to one with skill in the art that the ridges and grooves on the rollers may be implemented in a wide variety of ways while still accomplishing the purpose of the invention. It is also true that the grooves and ridges are not strictly required for the invention, but are a preferred feature. The regions of no contact are required.

Figures 4A, 4B, 4C:
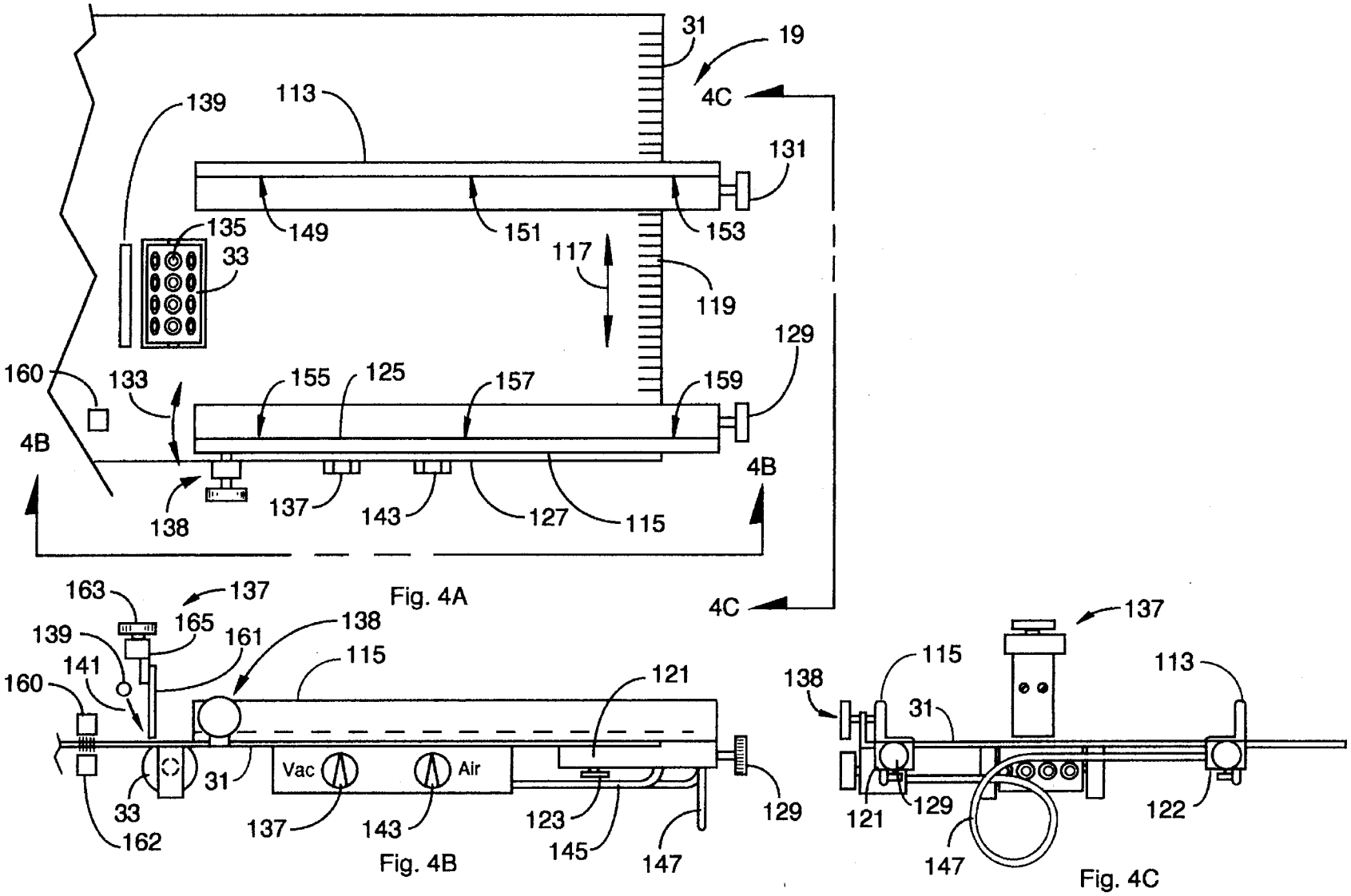
FIG. 4A is a plan view of a feeder apparatus for the invention.
FIG. 4B is an elevation view of the apparatus of FIG. 4A from line 4B—4B of FIG. 4A.
FIG. 4C is an end view of the apparatus of FIG. 4A taken from line 4C—4C of FIG. 4A.

FIG. 4A is a plan view of sheet feeding sub-system 19 in the general direction of arrow 30 of FIG. 1. The feeder comprises tray 31 and adjustable side guides 113 and 115. FIG. 4B is an elevation view of the sub-system 19 according to view line 4B—4B of FIG. 4A. FIG. 4C is an end elevation view of the sub-system according to view line 4C—4C of FIG. 4A.

Side guides 113 and 115 are adjustable in the direction of arrow 117, and graduation marks 119 along the edge of plate 31 are provided as an aid in setting the width of the side guides for forms of different widths. The graduation marks are a convenience, and may be provided in a variety of standards, such as English or Metric, or both.

A user typically adjusts one of the side guides rather than both, and the guide that is left fixed after initial adjustment is the guide closest to the operator's side of the machine, which in FIG. 4A, B and C is guide 115. One reason for this is that there are sensors and other equipment along the path of sheets fed through the apparatus, and these auxiliary devices would be out of place relative to a sheet if the position of one of the guides were not left substantially fixed. Another reason is to have a set position for the vacuum feed wheel relative to at least one side guide. In one embodiment the overall width of the machine allows sheets of up to 12 inches in width to be fed by adjusting the position of side guide 113.

The side guides are mounted to plate 31 by clamp apparatus having a clamp bar in the embodiment described. Clamp apparatus 121 for side guide 115 is exemplary, and is secured by a manually operated clamp screw 123. Similarly, for side guide 113 there is a clamp apparatus 122. There are many equivalent ways clamp bars and screws might be implemented, and similarly many other ways that side guides might be secured to be movable and adjustable. A steadying adjustment 138 in the embodiment described fastens to the frame of the machine and bears with an adjusting screw on the end of side guide 115 opposite clamp apparatus 121, to hold the otherwise free end of the guide and provide additional stability.

A useful feature of the side guides in the present invention is that they may be adjusted to compensate for sheets that are not cut perfectly square. Each of the side guides may be adjusted to form an angle with edge of plate 31, which in the embodiment described is square with the feed rollers and other elements of the self-mailer machine. For example, edge 125 of side guide 115 would be set to be parallel with edge 127 of plate 31 to feed sheets that are cut such that the front edge of the sheets is square with the sides, or at least one of the sides. In the event that the sheets are not cut square, if no adjustment is possible, the side guides will control the presentation of the front edge, and there could be problems in feeding the sheets or otherwise operating the equipment.

In the present invention a simple cam mechanism (not shown) within the clamp apparatus for each side guide allows a user to adjust the respective side guides to be parallel or not with the edge of plate 31. For side guide 115 rotating knob 129 will move the end of the guide opposite the clamp in an arc approximately according to arrow 133, pivoting about a point in clamp apparatus 121. Side guide 113 is similarly adjustable by manipulation of knob 131. Typically, although it is common for sheets to "out of square", the amount is within a few degrees, so the amount of rotative adjustment for the side guides need not be more than about 5 degrees maximum.

The speed at which the self-mailer machine of the present invention may operate, especially under conditions of being fully loaded with sheets to feed, is partly a function of feed-wheel 33, which is shown in FIG. 2 as well as FIG. 4A, B, and C. As partly described above, the feed wheel has radial vacuum passages for capturing a sheet from the bottom of a stack of sheets and feeding it forward until the sheet is captured and pulled by rollers 49 and 51 (see FIG. 2). Each radial passage, such as passage 135, is about 10 mm. in diameter, and there are four rows of passages. The total area of passages making contact with a sheet to be fed at any moment, then is about 315 $mm^2$. in the present invention.

A critical parameter to provide positive feeding under a load of sheets to be fed is the area of the contact between vacuum passages and the sheet to be fed. It has been found in development and testing that there is a practical upper Limit to the diameter of vacuum passages in feed wheel 33, because too large a diameter tends to deform the sheets enough to hinder reliable feeding. The upper limit is about 10 mm. To increase the effective vacuum area, then, it is necessary to increase the number of vacuum passages in a row that actually contact a sheet at the same time.

In the present invention, with four vacuum passages in a row contacting a sheet at about the maximum effective diameter of about 10 mm., the effective area is about 315 $mm^2$. It has been found in practice that to feed up to 30,000 sheets per hour with a full ream of sheets in the sheet-feeding sub-system requires an effective vacuum area of at least about 250 $mm^2$, so four rows of vacuum passages are needed with passages of 10 mm. diameter or smaller; three rows is not adequate.

The inventors recognize that a wheel is a convenient element for applying a vacuum interface, but not the only way. One might also provide a vacuum passage with one or more openings in combination with a mechanism for translating the one or more openings more or less linearly in the direction a sheet is to be fed to reach the first rollers. In this instance the practical upper limit to the size of a single opening in contact with the sheet is larger, and one might use a single opening. The area requirement remains about the same, though, to feed at up to 30,000 sheets per hour from the bottom of a full ream of sheets. In the system of the present invention, the vacuum level supplied is about 25 inches of mercury. For lower vacuum levels the area requirements must be adjusted accordingly.

In the present invention vacuum is supplied by vacuum pump and compressor equipment 27 (see FIG. 1). There are many arrangements suitable for supplying vacuum, the present system, with an air compressor and a vacuum pump driven by a common motor, is convenient. Conventional conduits lead from the vacuum pump inlet to a rotary choking valve 137 and then to feed wheel 33, which allows a user to adjust the effect of the vacuum feed by controlling the size of a limiting orifice in the flow path from the vacuum pump to the feed wheel.

Another feature of sheet-feeding subsystem 19 is air blow for aiding separation of sheets in feeding. Air under moderate pressure is delivered via convention conduits from vacuum pump and air compressor 27 (FIG. 1) to a choke valve 143 and then to a manifold 139 generally above and a little ahead of vacuum feed wheel 33, as shown in FIGS. 4A and B. The frame supports for the air manifold are not shown to avoid too much detail in the drawing. Air is also fed from valve 143 to passages within side guides 113 and 115 through conventional conduits such as conduits 145 and 147.

The passages in the side guides terminate in holes directing air inward from the guides toward the sheets in the feeder at typically three locations along the length of each guide rail. Locations 149, 151, 153, 155, 157, and 159 are exemplary. It will be apparent to one with skill in the art that there are a wide variety of locations where air might be suitably applied, and other ways to conduct the air to the points of application.

Adjustable paper stop 37, shown somewhat schematically in FIG. 2 is also shown in FIG. 4B and 4C (but not in 4A). Stop plate 161 is about 5 cm. in width in the embodiment described, and fastened to a vertically adjustable support structure 165 driven by a rotary knob 163 that a user may use to adjust the clearance between the lower end of stop plate 161 and plate 31. Again, the support structure is not shown to avoid confusion.

Typically, the gap between plate 31 and the paper stop is set by inserting two sheets of the sheets to be fed under the stop plate, and lowering the stop plate until snug against the two sheets on plate 31. The best setting is made by an iterative procedure involving initial setup, then feeding test sheets and readjusting.

Another feature of the feeder-folder of the present invention is a double-sheet detector comprising an optical source 160 and sensor 162, with sensitivity set to sense light through one sheet but not through two sheets. A reading is taken with the sensor at a point in time when at least one sheet is between the source and the sensor. Failure to sense light, meaning more than one sheet being fed, causes the self-mailer machine to stop. Wiring to the source and sensor are not shown.

Gluing Subsystem

Figure 5B:
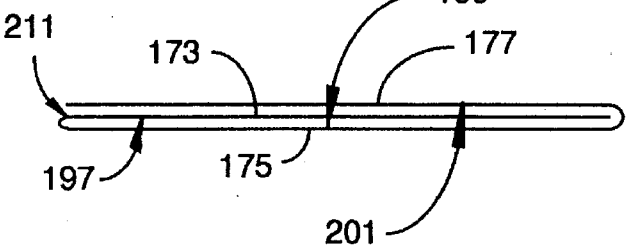
FIG. 5B is a side view of the sheet shown in FIG. 5A, with the folds further developed.
Figure 5A:
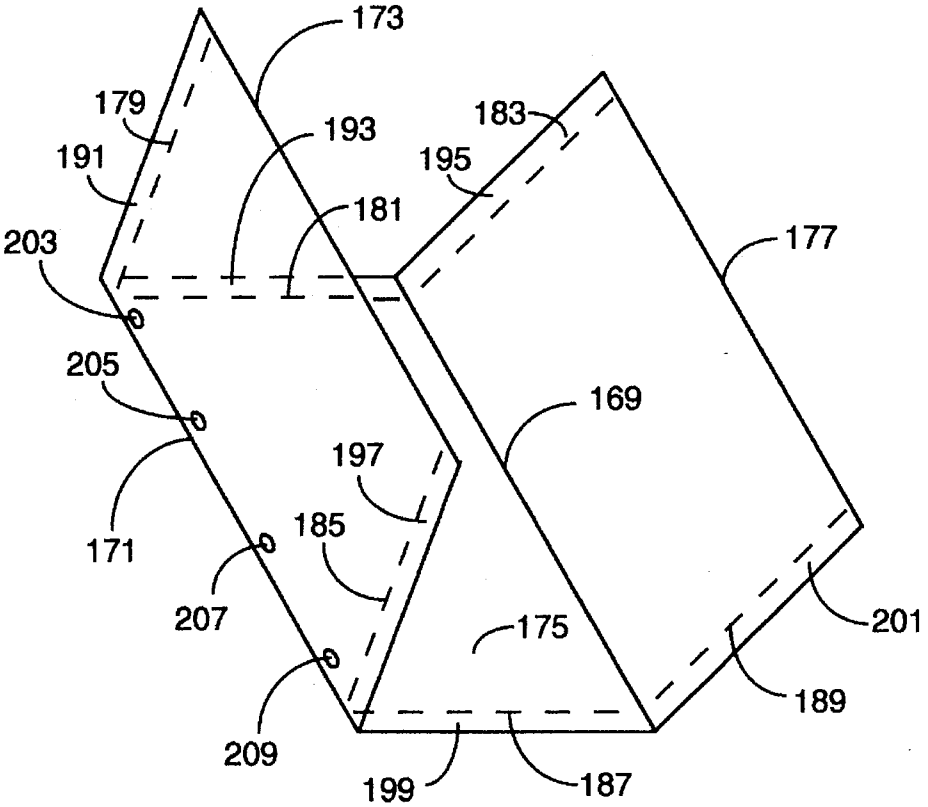
FIG. 5A is an isometric of one example of a folded sheet, folded according to one setup of the self-mailer machine of the present invention.

The Glue-Folder 503 machine applies a water-miscible, air-drying glue in the embodiment described. To make self-mailers it is typically necessary to apply glue along the sides of a sheet at several points along a fold line or a leading or trailing edge as well. FIG. 5A is an isometric view of a single sheet 167 of nominal U.S. letter size (8.5 by 11 inches) showing the typical positions of fold lines and glue application for a tri-folded self mailer. FIG. 5B is an end view of sheet 167 with the folds approaching 180 degrees to better illustrate the adhesion of parts to produce a tri-folded self-mailer.

In the example of FIGS. 5A and 5B there are two fold lines 169 and 171 made requiring two folding plates as described above with reference to FIG. 2. The two fold lines separate the sheet into three areas 173, 175, and 177. Dotted lines 179, 181,183, 185, 187, and 189 define edge regions 191, 193, 195, 197, 199, and 201. It is within these edge regions that glue is applied, and it is also these edge regions that are defined by perforations (described below) to facilitate opening of the resulting self-mailer.

In the self-mailer machine of the present invention semi-liquid glue is applied in the edge regions by stationary glue guns as the sheets pass. Glue is typically applied on one side only, which is the side folded inward. To effectively seal the self mailer, glue dots are also applied along fold line 171 on the side facing out after folding. Glue spots 203, 205,207, and 209 are examples. There could be more or fewer such spots. Generally, each spot requires a separate glue gun.

FIG. 5B illustrates the adhesion of the glued areas to make self-mailers. The folds are shown at 180 degrees, and the fold lines are relaxed to better show the three separate folded areas 173, 175, and 177. Glue fed along the edges of the separate areas in regions 197, 199, and 201 (and also regions 191, 193, and 195 not seen in FIG. 5B) cause the edges to adhere to seal the three areas into a self-mailer. Glue spots 203, 205, 207, and 209 are in region 211 indicated in FIG. 5B, and cause the open edge of the folded self-mailer to be effectively closed as well.

It will be apparent to one with skill in the art that a self mailer can be made with two folded areas from one fold line, and even from four (or more) folded areas, with one or more areas enclosed in the final mailer.

Figure 6B:
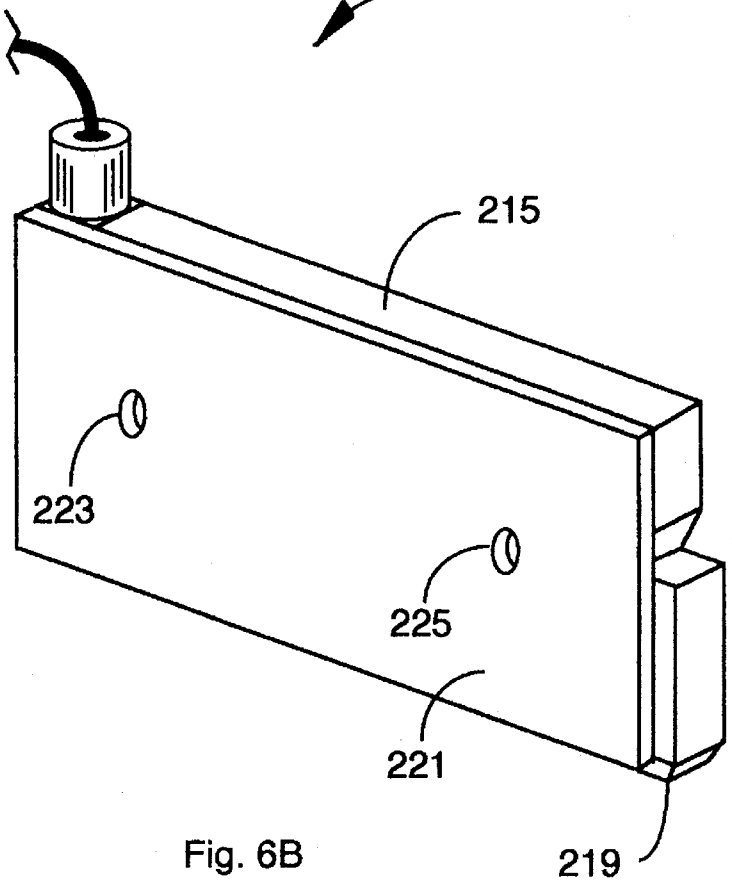
FIG. 6B is another isometric of the glue gun module of FIG. 6A, at a different angle than in FIG. 6A.
Figure 6A:
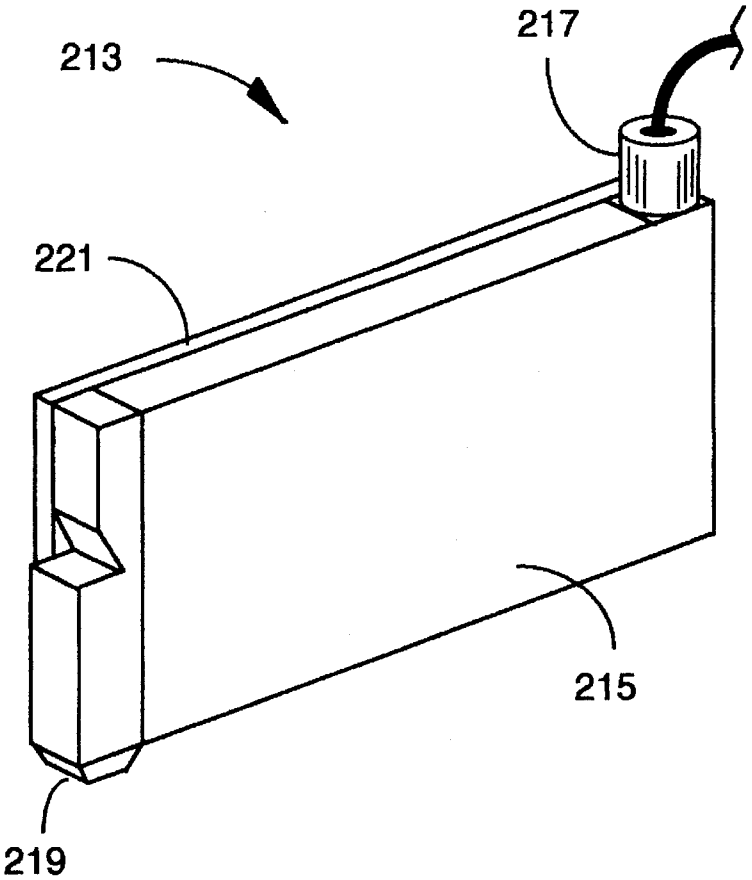
FIG. 6A is an isometric view of a glue gun module as used in the invention.

FIG. 6A is an isometric view of a glue gun 213 comprising a body 215 having an actuating solenoid 217 and a dispensing tip 219, attached to a mounting plate 221. FIG. 6B is an isometric of the same assembly shown in FIG. 6A, but at a different angle. Mounting plate 221 has two mounting holes 223 and 225 which are used to mount the assembly to a rail that spans the width of the self-mailer machine, and to adjust the height of dispensing tip 219 above a passing sheet to which glue is to be applied.

Glue is delivered to glue guns in the present invention from pressurized glue reservoir 25 (FIG. 1) via conventional conduits, some of which are flexible lines to allow certain components to be moved.

Figure 7:
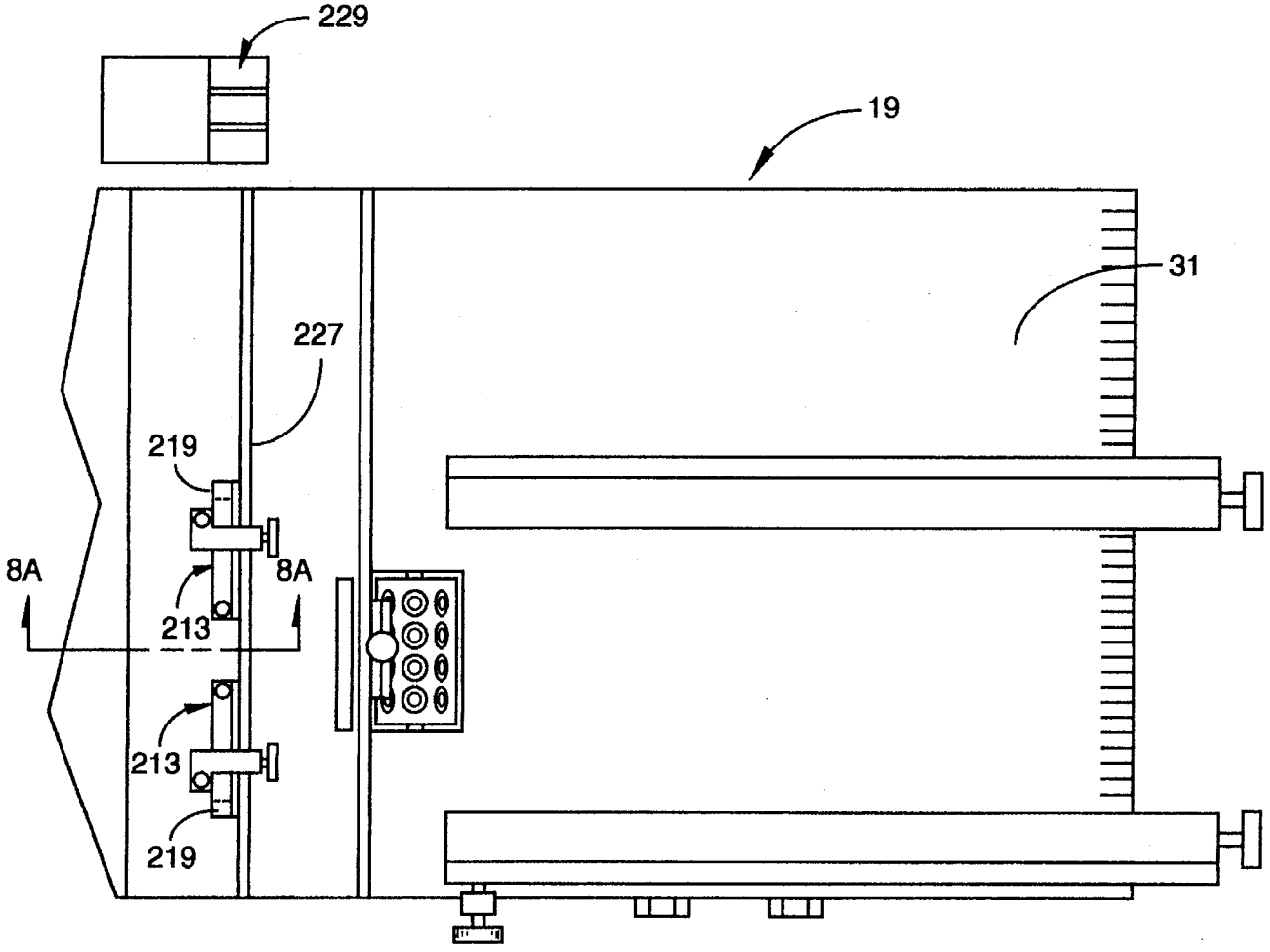
FIG. 7 is plan view similar to the view of FIG. 4A, with the addition of two glue gun modules on a mounting rail and a purge and cleaning apparatus.

FIG. 7 is a plan view of sheet feeding sub-system 19 similar to FIG. 4A, showing a mounting rail and paper guide 227 with two glue gun assemblies 213 mounted to the rail. The glue guns may be adjusted in position along mounting rail 227 so the tips 219 are directly over the edge regions of the sheets as the sheets pass under the dispensing tips. Glue lines and control lines to the guns are flexible and implemented with sufficient slack so the gun assemblies not only may be adjusted along the mounting rail, but may also be removed and placed upon a purge and cleaning apparatus 229 carried on the machine frame.

Figure 8B:
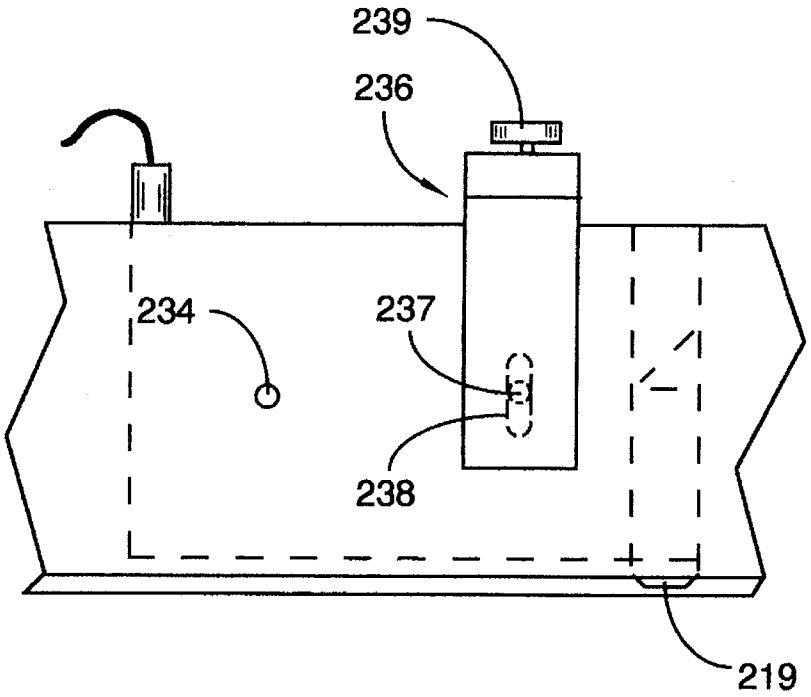
FIG. 8B is an elevation view of the apparatus of FIG. 8A from the vantage of arrow 231 of FIG. 8A.
Figure 8A:
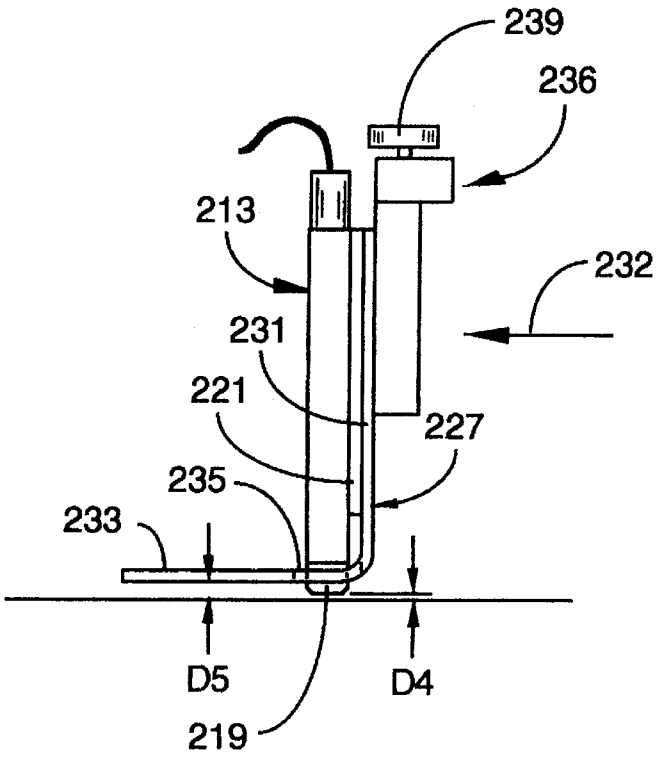
FIG. 8A is an elevation section view of one of the glue gun modules of FIG. 7 to illustrate adjustment apparatus for setting the height of the applicator tip of the gun relative to a passing sheet.

FIG. 8A is a view of one gun assembly 213 mounted to mounting rail 227 viewing in the direction of section line 8A—8A of FIG. 7. Rail 227 has a substantially vertical leg 231 for mounting the gun assemblies and a substantially horizontal leg 233 for forming the top of a paper guide channel of height D5 for paper entering the machine. The direction of paper being fed is from right to left in FIG. 8A.

Glue gun assembly 213 is mounted to rail 227 by plate 221 and a pivot pin 234 passing through rail 227 and engaging hole 223 (FIG. 6B). FIG. 8B is an elevation view of the apparatus of FIG. 8A from the vantage of arrow 232 of FIG. 8A, and shows the position of pivot pin 234. The mounting of the glue gun to vertical leg 231 of rail 227 is such that dispensing tip 219 extends through an opening 235 in horizontal leg 233 of rail 227, and is thus disposed to dispense glue on paper passing under rail 227.

A vertical adjustment mechanism 236 mounts to leg 231 of rail 227 and is disposed to raise and lower a pin 237 passing through a slot 238 in rail 237 and engaging hole 225 (FIG. 6B). By turning knob 239 a user may raise and lower pin 237, thereby pivoting glue gun assembly 213 around pivot pin 237, which raises and lowers dispensing tip 219. Rail 227 is mounted to the framework of the machine such that the position (height) of rail 227 may be adjusted, which serves both as a rough setting for the glue guns and as an adjustment for height D5 of the rail over the paper path. The finer adjustment by knob 239 serves as a precise adjustment for the height D4 of tip 219 over a passing sheet.

The glue gun assemblies may be quickly and easily removed for service. As described above, power and glue are provided in flexible connectors, such that the guns may be moved to a cleaning and purging tray without disconnecting power or glue. The connection of the guns to rail 227 allows the guns to be quickly and easily removed by withdrawing each assembly from its respective pivot.

It will be apparent to one with skill in the art that the mechanism described is a convenient means of mounting and adjusting the height of the glue gun assembly, and there are many equivalent ways to accomplish the same purpose.

An optical sensor (not shown) positionable along the paper path senses the arrival of a sheet in operation and signals the control system to begin dispensing glue. Having each of the two gun assemblies in the same position relative to the paper path, that is, on the same side of rail 227, ensures that a glue stripe applied by each gun will begin at the same position on a sheet relative to the length of the sheet.

The description above with reference to FIGS. 5A and 5B references glue spots 203–209 applied along a fold line to effectively seal a self mailer. These glue spots are applied for a tri-folded mailer as described herein by a row of four glue guns in an assembly 249 mounted by clamps (not shown) on lower folding plate 71, shown in FIG. 2. The dispensing tips of the four guns protrude through openings in the folder plate assembly to a point near the folded edge of a sheet as it encounters stop 79. An optical sensor (not shown) signals the control system to provide a timed dispensation of glue to accomplish the glue spots.

In the self-mailer machine of the present invention, glue is provided in a sealed container with a perforatable top membrane to avoid spills and other messy procedures, and to provide a means for providing fresh glue that need not be excessively exposed during the loading operation.

Figure 9:
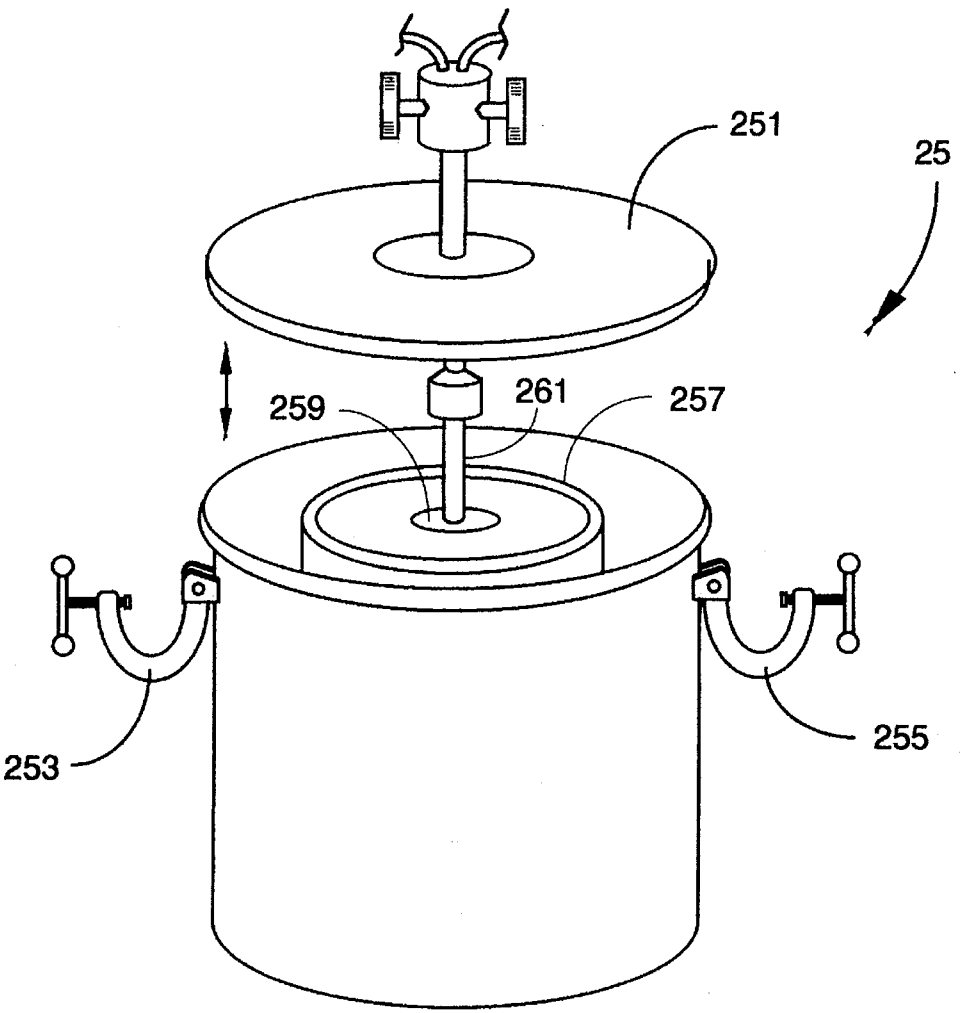
FIG. 9 is an isometric of a glue reservoir in the invention, showing a sealed bucket and a puncturing stem for perforating a seal on the bucket.

FIG. 9 shows glue reservoir 25 of FIG. 1 with top 251 loosened and removed for loading. The top has a gasket seal as is common with pressure reservoirs in the art, and is clamped in place by C-type clamps 253 and 255 shown. Typically four clamps are used. Glue is supplied in a closed container 257, typically molded plastic, with a membrane 259 in the center of the top closure.

When a previous glue container is empty, reservoir 25 is vented and top 251 is removed. The empty inner container is removed and discarded and a new, full container 257 is placed in the reservoir. Stem 261 sealed through top 251 is inserted into the glue container breaking seal 259. Top 251 is lowered into position and clamped. The reservoir is then re-pressurized ready for further operation.

Perforation Sub-System

In the process of making self-mailers, typically perforations are made at least along the edge regions (see FIG. 5A). This is an aid in opening the mailer. A recipient of a mailer with such perforations may grasp the mailer and an edge, quickly tear off the edge region, then repeat the process on the opposite edge. The mailer is usually easy then to open along the spot glued seam.

In the self-mailer machine of the present invention the perforation sub-assembly is located just after the last mating engagement of feed rollers before the finished self-mailers are deposited on the output conveyor. In FIG. 2, the perforation sub-assembly is indicated by assembly 263 comprising rollers 265 and 267, which are driven together similar to the way feed rollers are driven to perforate edges of mailers and deposit the mailers on the output conveyor.

Figure 10:
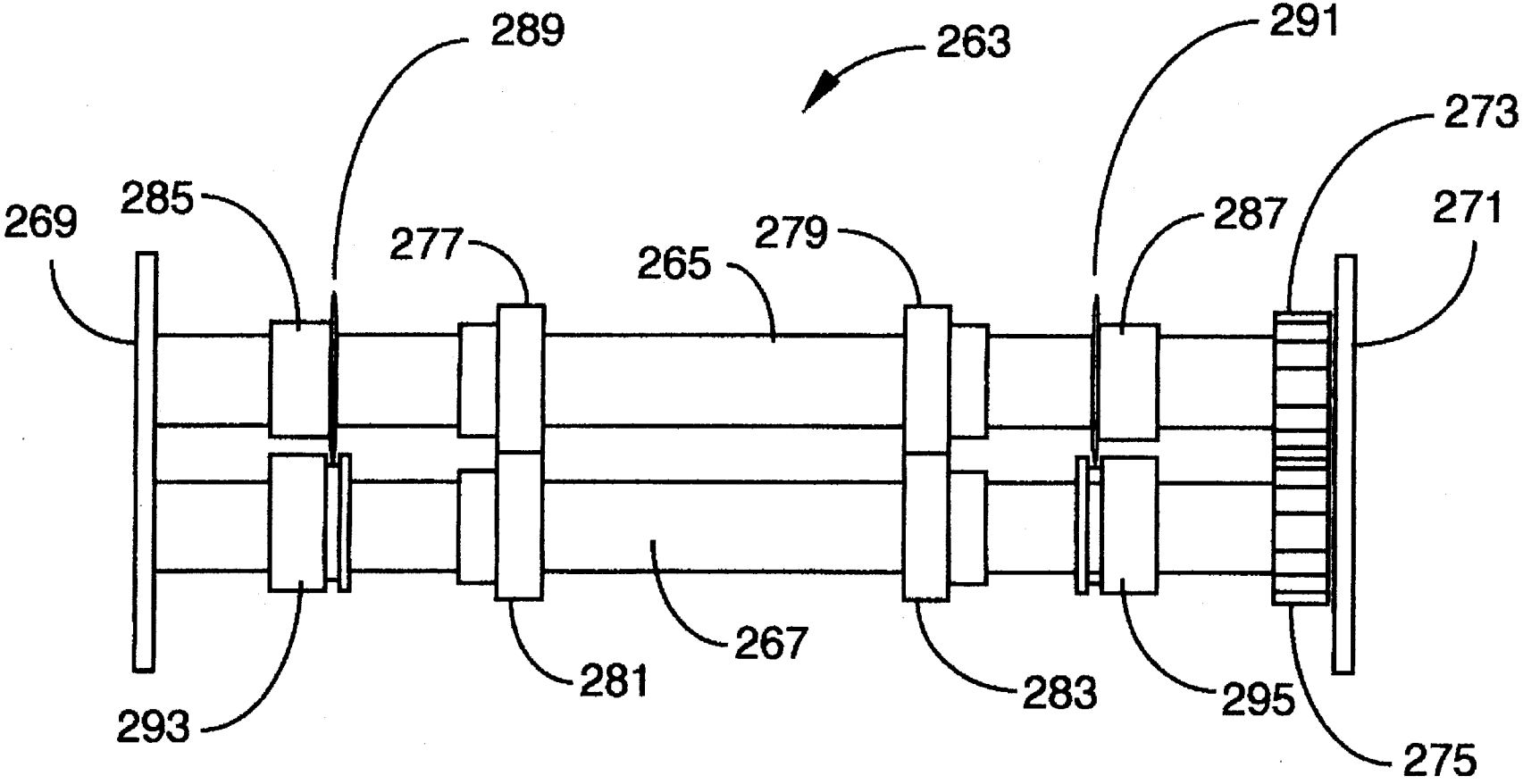
FIG. 10 is an elevation view of rollers for making perforation lines in folded sheets for self-mailers to provide tear-off strips.

FIG. 10 is a view from about the advantage of the output conveyor back toward perforator sub-assembly 263 showing rollers 265 and 267 mounted rotatably in end plates 269 and 271, which provides a modular unit which may be assembled to and dis-assembled from the self-mailer machine. Mating gears 273 and 275 mounted on the rollers cause the rollers to rotate together, and one of the gears also mates with a gear (not shown) on one of the feeder rollers, so all the rollers, including the perforator rollers, are driven together.

There are four pull-out wheels 277, 279, 281, and 283 mounted on the rollers in a manner that two sets of mating rollers are provided for helping to pull folded self-mailers through the perforator assembly. There are two blade mounting collars 285 and 287 mounted on roller 265. Collar 285 has a perforator blade 289 attached and collar 287 has a similar blade 291 attached. Each blade has an engaging counter knife mounted on roller 267. Counter knife 293 engages blade 289 and counter knife 295 engages blade 291.

In the perforator assembly there is a paper stripper (not shown) for each blade and counter knife unit to prevent paper from wrapping around the perforating blade. The paper strippers are flexible metal strips positioned to strip the paper from the rollers.

Forms Compactor

As described above, the self-mailer machine of the invention operates at speeds of up to 30,000 forms per hour. This speed is equivalent to more than eight forms per second. Because of the high speed that can be attained, a sheet becomes a self-mailer in this machine in a very short time. The high speed, while very desirable for throughput, can contribute to a problem, especially when using relatively heavy weight paper for the self-mailers. The problem is that the glue does not have time to cure, and the self-mailers tend to open to some extent after leaving the machine.

Figure 13A:
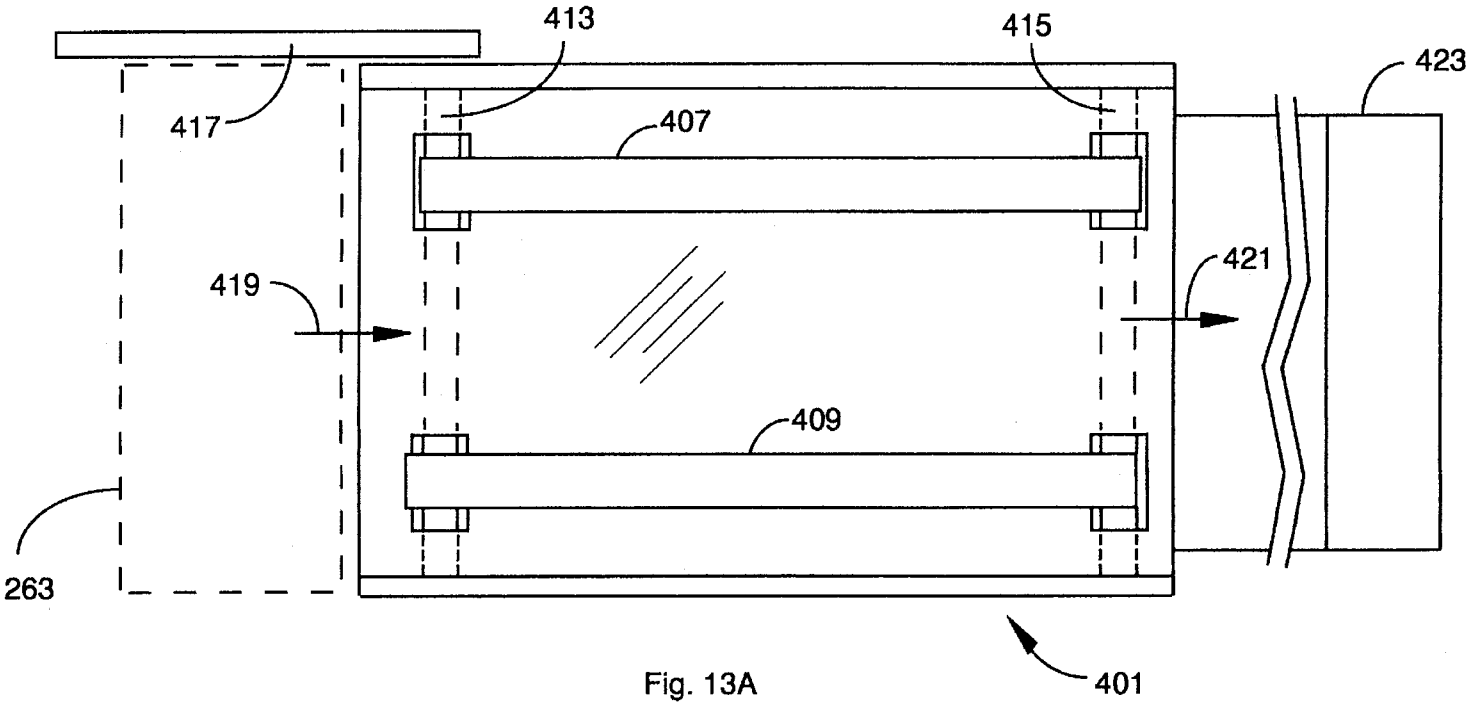
FIG. 13A is a plan view of a forms compactor according to an embodiment of the invention.
Figure 13B:
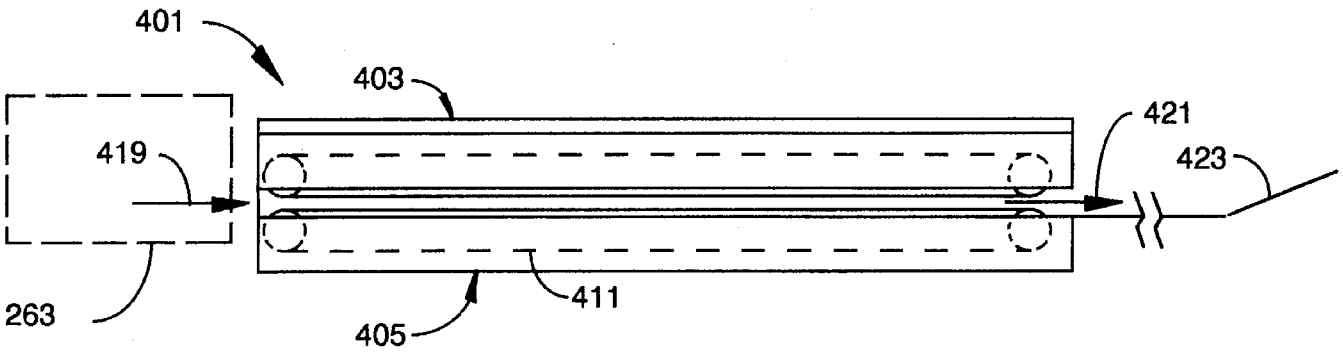
FIG. 13B is an elevation view of the forms compactor shown in FIG. 13A.

FIG. 13A is a plan view of a forms compactor 401 according to an embodiment of the invention, assembled at the exit of self-mailer machine 11. Compactor 401 is provided as an optional addition to the self-mailer machine described above. FIG. 13B is an elevation view of the apparatus of FIG. 13A.

Forms compactor 401 is an over-under conveyor which receives the substantially completed forms exiting perforation sub-assembly 263 (represented by a dotted enclosure) and keeps each form closed for the time it takes for a form to travel the full length of the compactor. Referring to FIG. 13B, there is an upper conveyor section 403 and a lower section 405. Each section has, in the embodiment shown, a pair of conveyor belts. Belts 407 and 409 are in upper section 403 (FIG. 13A), and belt 411 is shown in lower section 405 (FIG. 13B). Belts 407 and 409 in the upper section are driven by shafts 413 and 415, and shaft 413 is driven by a drive train mechanism 417, such as a drive belt, from the primary drive of the self-mailer machine. The conveyor belts in the lower section are driven by similar shafts (not shown), which are driven from the common drive to match the linear speed of the upper conveyor belts.

Forms exiting the perforator sub-assembly 263 in the direction of arrow 419 are compressed between the belts of the upper and the lower sections of compactor assembly 401 while traveling the length of the conveyor, and exit (arrow 421) to a catch tray 423, which may be provided in different lengths to hold a different quantity of forms when "full". In some embodiments, upper section 403 is added to a self-mailer machine to operate with an already existing lower conveyor section 21 (see FIG. 1 and FIG. 2), and in other instances, the compactor is provided as a unit. In still other embodiments the upper section is pivoted at the end near the perforator sub-assembly, and free on the exit end, so the weight of the upper section bears on the forms passing through, as an aid in compression.

As an example of operation of the compactor, for a self-mailer machine according to the present invention operating at three forms produced per second (10,800 per hour), the compactor conveyor will typically be set to travel at about ⅜ of an inch per second. This speed provides 144 forms at any time in the length of the compactor on ⅛ inch increments, and the residence time per form is about 48 seconds. Since the compactor is physically connected to a driven by the self-mailer machine, as the speed of the self-mailer machine is changed, the speed of the compactor conveyors changes as well, and the ratios remain the same. The minimum length of time a form will be in the conveyor decreases, however, as the speed of the self-mailer machine increases.

Rotator/Perforator

There are many instances in making self-mailers when it is desirable to make a perforation line across the width of a form passing through the self-mailer machine rather than, or in conjunction with, perforation lines in the direction of travel. Perforation subassembly 263 described above is capable of providing perforation lines only in the direction of travel of a self-mailer through the machine. FIG. 5A and 5B provides a good illustration of the difference. Sub-assembly 263 provides perforations, for example, along lines 179, 181, and 183. By "across the form" is meant lines parallel with the fold lines, such as lines 169 and 171.

Rolling perforator wheels, as described for sub-assembly 263, have been shown to be a preferable method for making perf lines, but to do perf lines in this manner when the lines are to be parallel to the fold lines, requires that the self-mailers passing through the machine be rotated after folding to pass through a second set of perf wheels similar to the set described for sub-assembly 263.

Figure 14A:
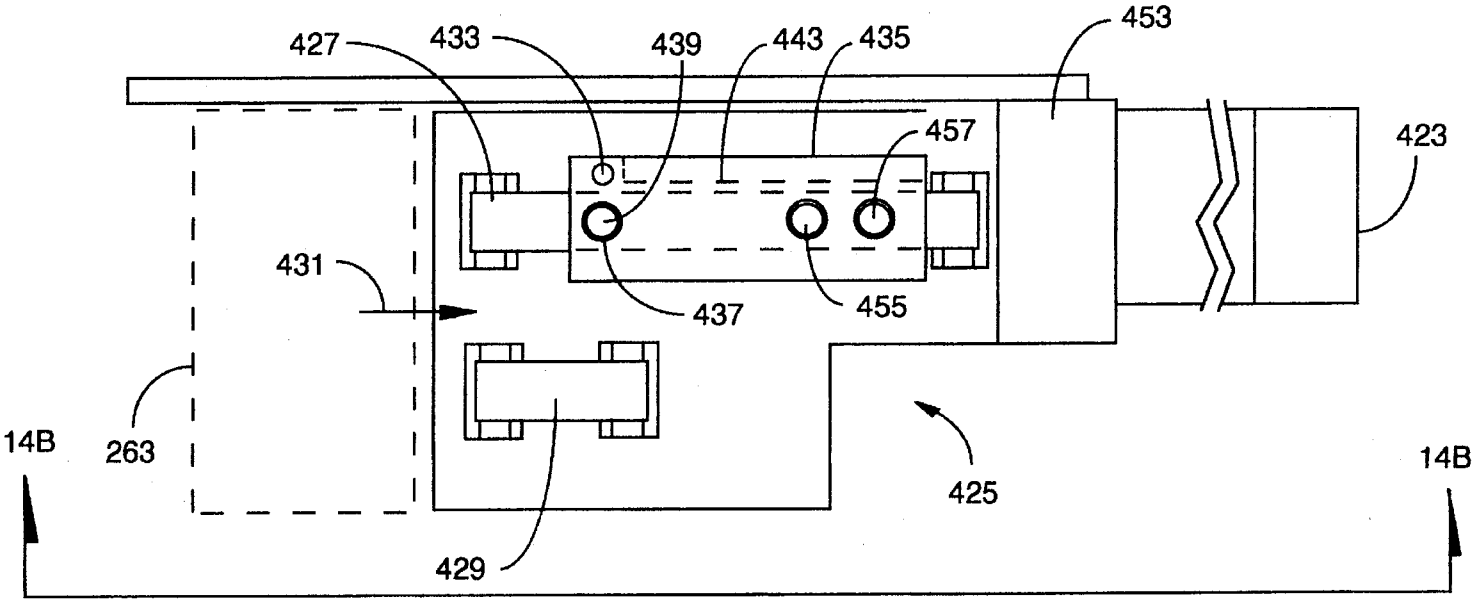
FIG. 14A is a plan view of a Rotator/Perforator according to an embodiment of the invention.

In the present invention a rotator/perforator 425 operating at the speed of the self-mailer machine is provided for rotating folded forms and making perf lines parallel to the fold lines. FIG. 14A is a plan view of rotator/perforator 425 operating at the exit of perforator sub-assembly 263 at the exit of a self-mailer machine according to the invention. In some embodiments of the invention, when no perf line or lines parallel to the fold lines are needed, the rotator/perforator is not needed either, and not included. In other embodiments the rotator/perforator may be positioned at the exit to the perf subassembly 265 as shown in FIG. 14A, and some other embodiments, the rotator/perforator is positioned at the end of the compactor assembly described above. The rotator/perforator, as well as the compactor described above, may be added to the self-mailer machine as optional equipment to be installed and used as needed.

The rotator/perforator has a pair of conveyor belts 427 and 429 for accepting folded forms from perforator sub-assembly 263 in the direction of arrow 431. Belts 427 and 429 are typically set to a linear speed somewhat faster than the linear speed of forms passing through sub-assembly 263. These forms are oriented with fold lines across the width of the machine; that is, at a right angle to the direction of travel. A pivot post 433 is positioned in the path of travel of a form, near one side, so a leading edge of an advancing form will strike post 433 as the form advances on conveyor belts 427 and 429.

Figure 14B:
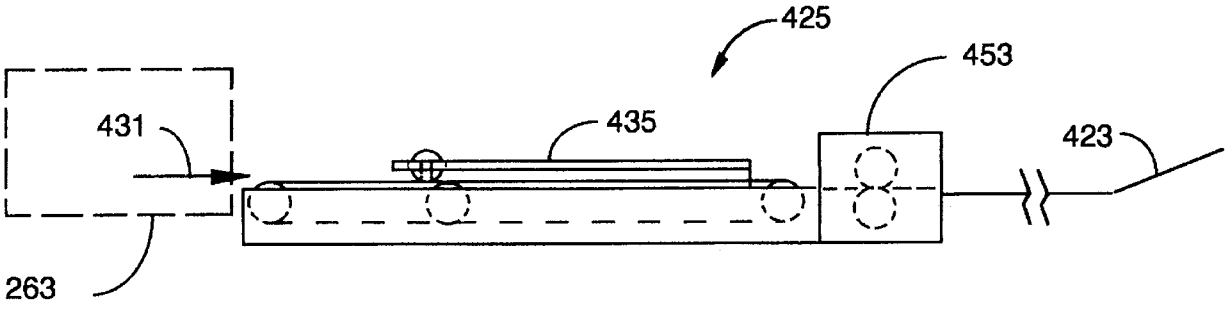
FIG. 14B is an elevation view of the apparatus of FIG. 14A.

FIG. 14B is an elevation view of the apparatus of FIG. 14A, viewing in the direction of view line 14B—14B of FIG. 14A. An upper plate 435 is spaced apart from conveyor 427 and spans that conveyor. A hole 437 in plate 435 holds a hardened and smooth steel ball 439 such that the ball rests on conveyor belt 427 when there is no form passing between the ball and the conveyor belt. In some embodiments hole 437 is lined with a hardened insert. In other embodiments an insert of bearing material, such as a porous bronze filled with a dry lubricant, is used. Inserts are not shown in FIG. 14A or FIG. 14B.

Figure 14C:
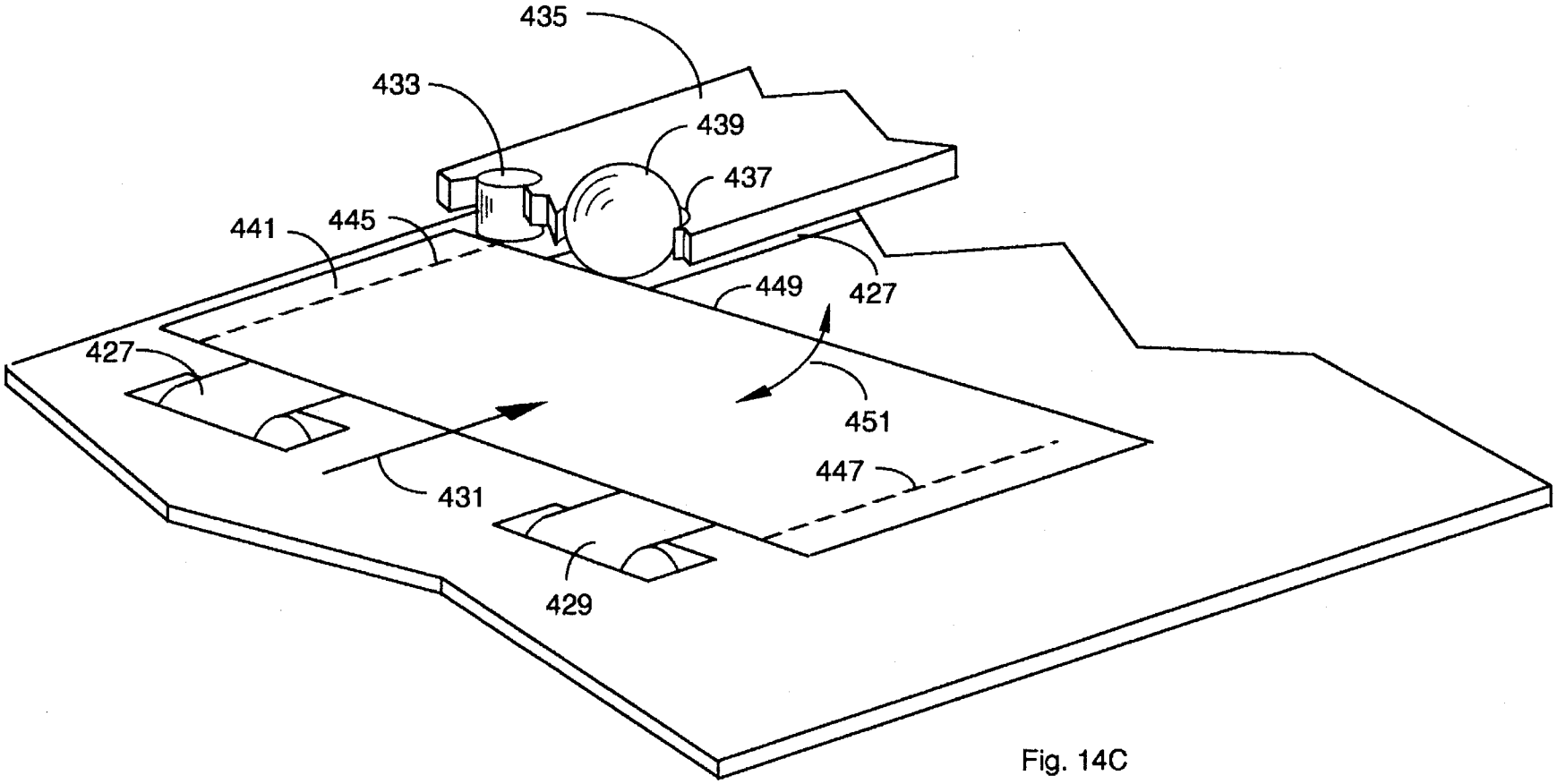
FIG. 14C is an isometric view of elements of the apparatus of FIG. 14A to illustrate form rotation.

FIG. 14C is an isometric view of a portion of the rotator/perforator near pivot post 433 to better illustrate the apparatus and its function. In FIG. 14C a form 441 is advancing in the direction of arrow 431 on belts 427 and 429, and has just contacted pivot post 433 and encountered ball 439 resting on belt 427. Form 441 is shown with two perf lines 445 and 447 in the direction of travel of the form.

As leading edge 449 encounters pivot post 433 and ball 439 the point of the leading edge that hits the pivot post stops moving in the travel direction, and the point that encounters the ball is "pinched" between the ball and the conveyor and accelerated in the direction of travel, causing the form to rotate rapidly in the direction of arrow 451.

Figure 14D:
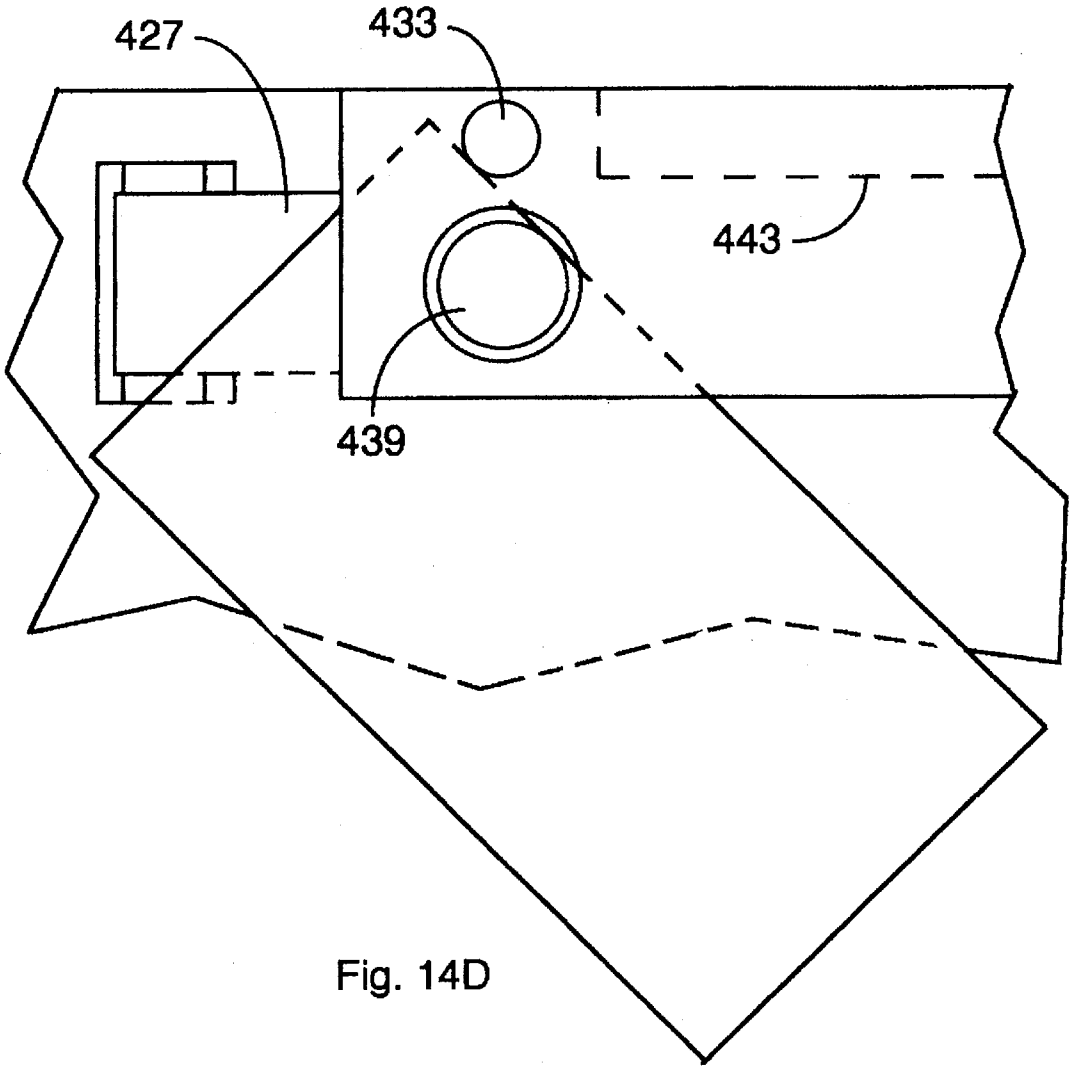
FIG. 14D is a plan view showing a form partly rotated by the apparatus of FIG. 14A.
Figure 14E:
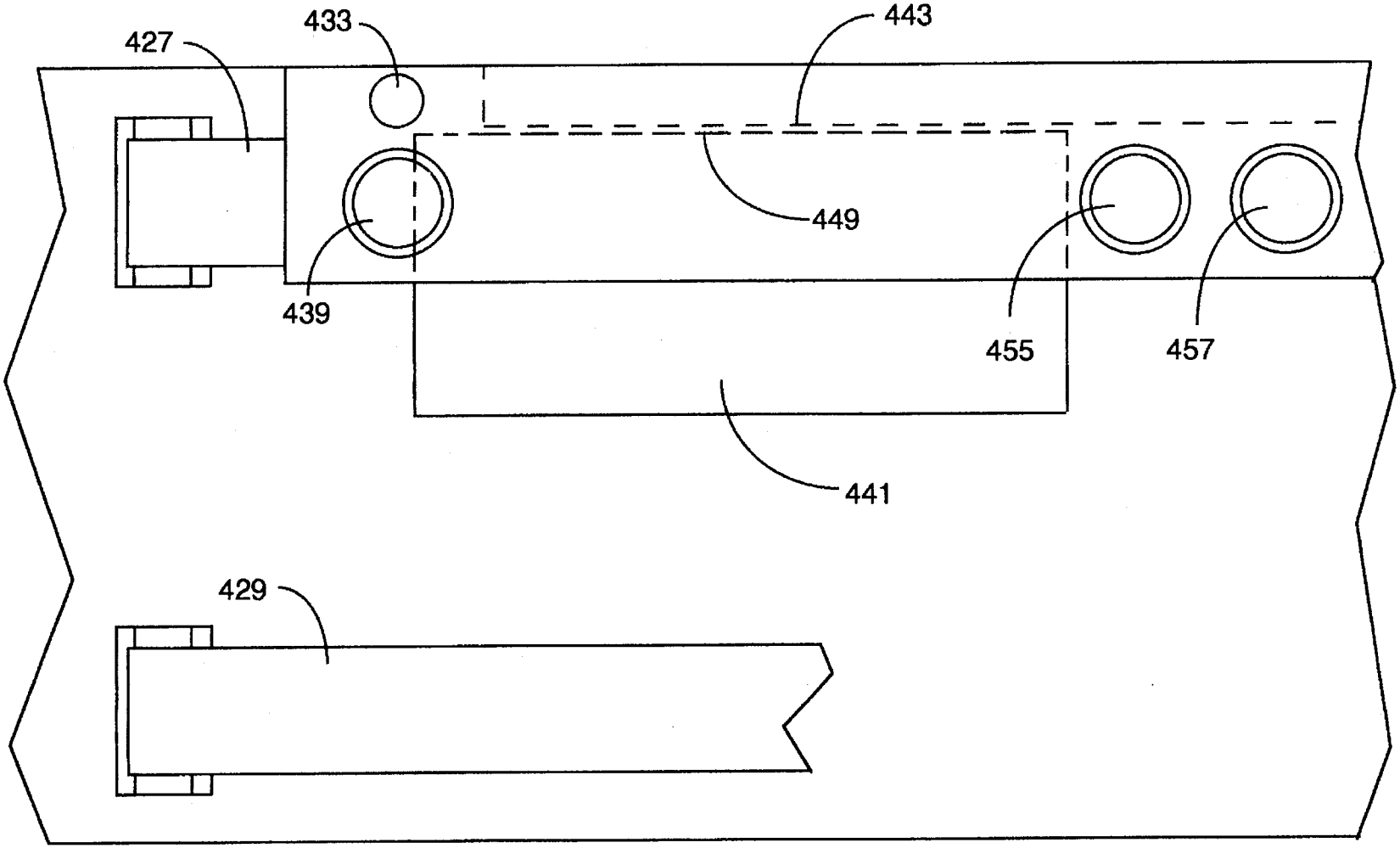
FIG. 14E is a plan view showing a form fully rotated by the apparatus of FIG. 14A.

FIGS. 14D and 14E show in plan view positions of form 441 immediately subsequent to beginning of rotation. In FIG. 14D the form is rotated about 45 degrees, and in FIG. 14E the form is rotated 90 degrees, and edge 449 has encountered a side guide 443 aligned with the "front" edge of post 433. Guide 443 prevents further rotation and guides the rotated form into perf assembly 453, which is similar to perforation sub-assembly 263 described above. After full 90 degree rotation, there are second and third balls 455 and 457 for helping to propel the rotated form into the perf assembly. In some embodiments, wheels are used in place of one or more of the balls illustrated and described herein.

Figure 15:
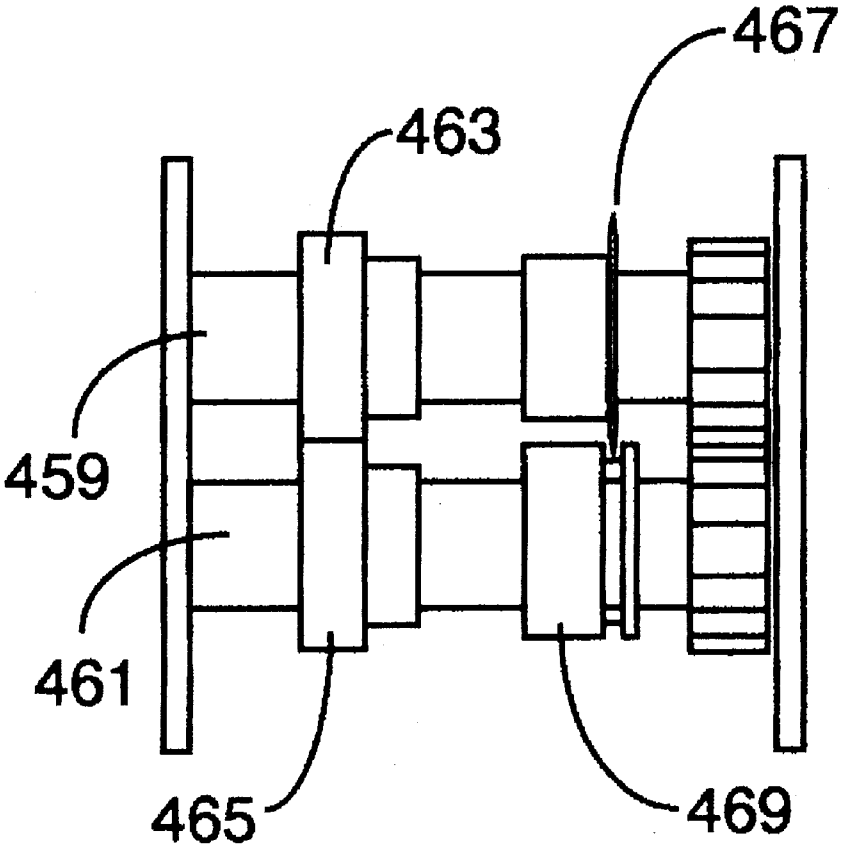
FIG. 15 is an elevation view of the perf assembly of the Rotator/Perforator of FIG. 14A.

FIG. 15 is an elevation view of elements internal to perf assembly 453 from the vantage of view line 15—15. There are two shafts 459 and 461 in this embodiment , with pull-out rollers 463 and 465. A perforating blade 467 engages a counter knife 469 at the position a perforation line is wanted from the edge of the form. The perf assembly is mounted with bearings (not shown) in side plates and gear driven by drive connections (also not shown) from the primary drive of the self-mailer machine. After the perf assembly, forms are delivered typically to a tray 423 as shown in FIG. 14B for eventual collection.

The rotator/perforator described herein is, as stated above, designed as an optional addition to the self-mailer machine also described in embodiments above. The rotation elements and the rotation elements combined with the perf assembly also have application to other form feeding and folding machines than the one described herein. For example, a rotator may be provided to align with conveyors or other equipment to accept forms and other flat entities of many types, rotate them, and send them along to other equipment. A rotator/perforator according to the present invention may similarly be used to both rotate and perforate forms and other flat entities of many types.

It will be apparent to one with skill in the art that there are many changes that may be made to the embodiment of the rotator/perforator described herein without departing from the spirit and scope of the invention. The rotating speed of a form, for example, may be controlled by varying the distance between the pivot post and the ball that accelerates the form, or between the pivot post and the wheel that accelerates the form, if a wheel is used. There are alternatives to the conveyor belts shown and to many other elements as well, with the alternatives being equivalent to the elements described herein.

System Control

Figure 11:
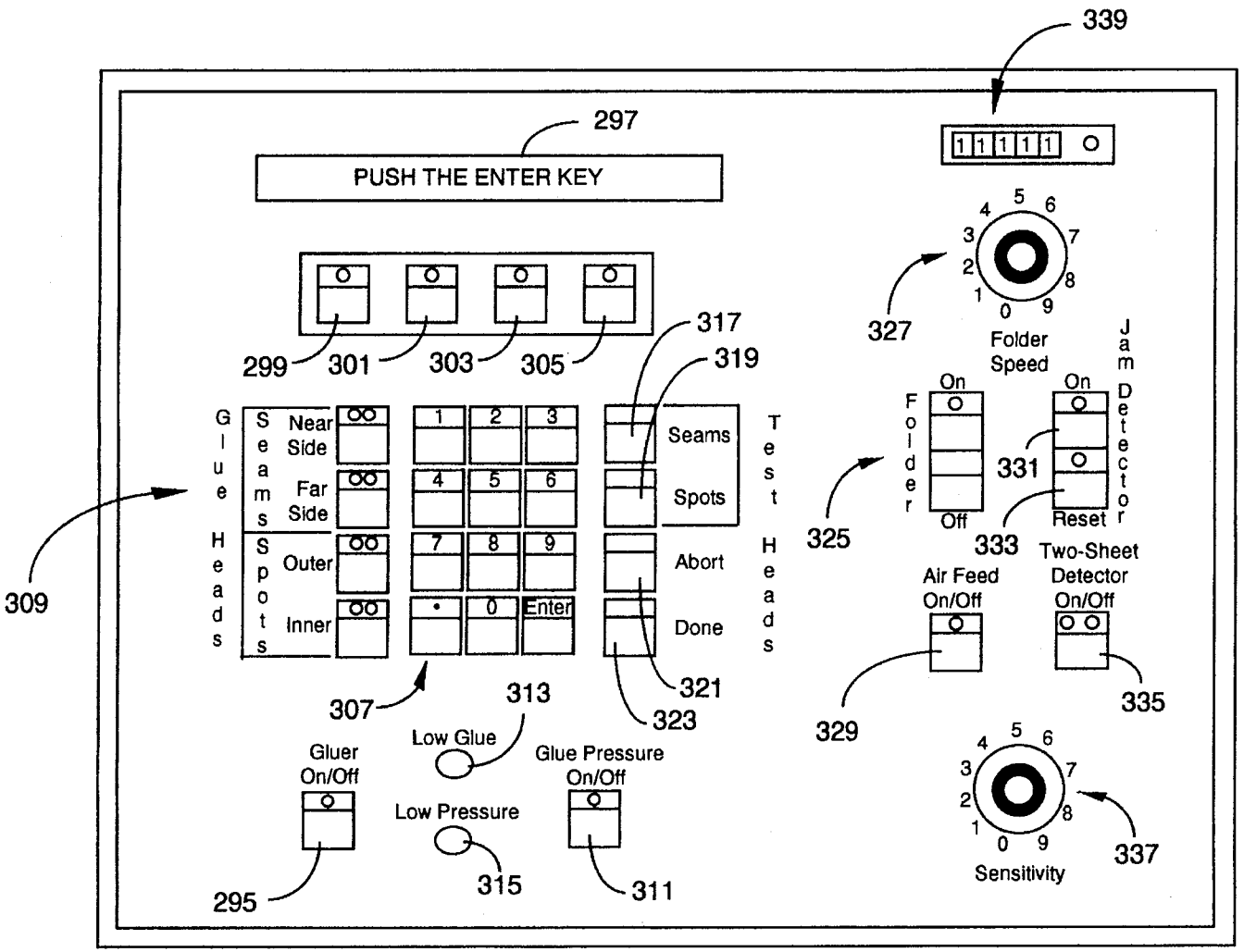
FIG. 11 is face view of a control panel with a display as used in a preferred embodiment of the invention.

The self-mailer of the present invention is controlled by a microprocessor-based system indicated as element 17 in FIG. 1. FIG. 11 is a view of a control panel 293 associated with the control of the self-mailer machine of the present invention, and also seen in less detail in FIG. 1.

Control panel 293 comprises an array of pushbutton keys, knobs, and displays for a user to use as an interface in controlling the machine. Key 295 is the Gluer On/Off key, and functions to turn the computerized control on and off as a toggle. An indicator in the key communicates that the control is on. A message panel 297 comprises an LCD display for the control system to display variable values and other information, and to present questions to a user.

There are four "soft" keys associated with message panel 297 for selecting menu items displayed. These are keys 299, 301, 303, and 305 located in a row directly under the panel. When menu selections are displayed they will be aligned in the message panel with one or another of the "soft" keys. A keypad 307 has conventional number keys for all of the decimal digits, and a decimal point key and an enter key. A user uses these keys to enter values requested by the computer on the message panel.

There four glue head keys in a group 309 for turning glue actuators (guns) on and off individually. A glue pressure key 311 turns the compressor on and off that pressurizes the glue reservoir 27 (FIG. 1). Also associated with the glue reservoir are warning lights 313 and 315 that indicate "glue out" or "pressure incorrect" respectively for the glue reservoir.

Keys 317 and 319 are for actuating the glue guns in groups when (and only when) purging the glue system. One key purges the guns that glue the edge regions, and the other is for the "spot" guns. Abort key 321 is for aborting system operations, and Done key 323 resets the system for a new batch of sheets to be run.

Keys 325 turn the folder on and off. Rotary knob 327 is for setting the folder speed. The speed is not set in absolute units, but as a percentage. A setting of 5, for example, sets the folder speed at 50% of maximum speed. Air feed key 329 turns the air blow and vacuum on and off, and starts the paper feeding.

Key 331 is for turning the jam detection system on and off. Key 333 resets the jam detector after a jam is cleared. Key 335 turns the double-sheet detector system on and off. Knob 337 sets the sensitivity of time two sheet detector, and the setting operates on a percentage mode just as does the folder speed knob. Indicator 337 is a counter indicator for counting and displaying the number of sheets processed in a single batch.

The control system of the present invention is programmable. It is provided in the embodiment described with a menu-driven operating system wherein menu prompts are provided on message panel 297 and a user may use soft keys 299–305 to make selections and key pad 307 to enter needed values. It is provided in time same embodiment with 4 programs, which a user may alter and adjust. A user may also make new programs.

Figure 12:
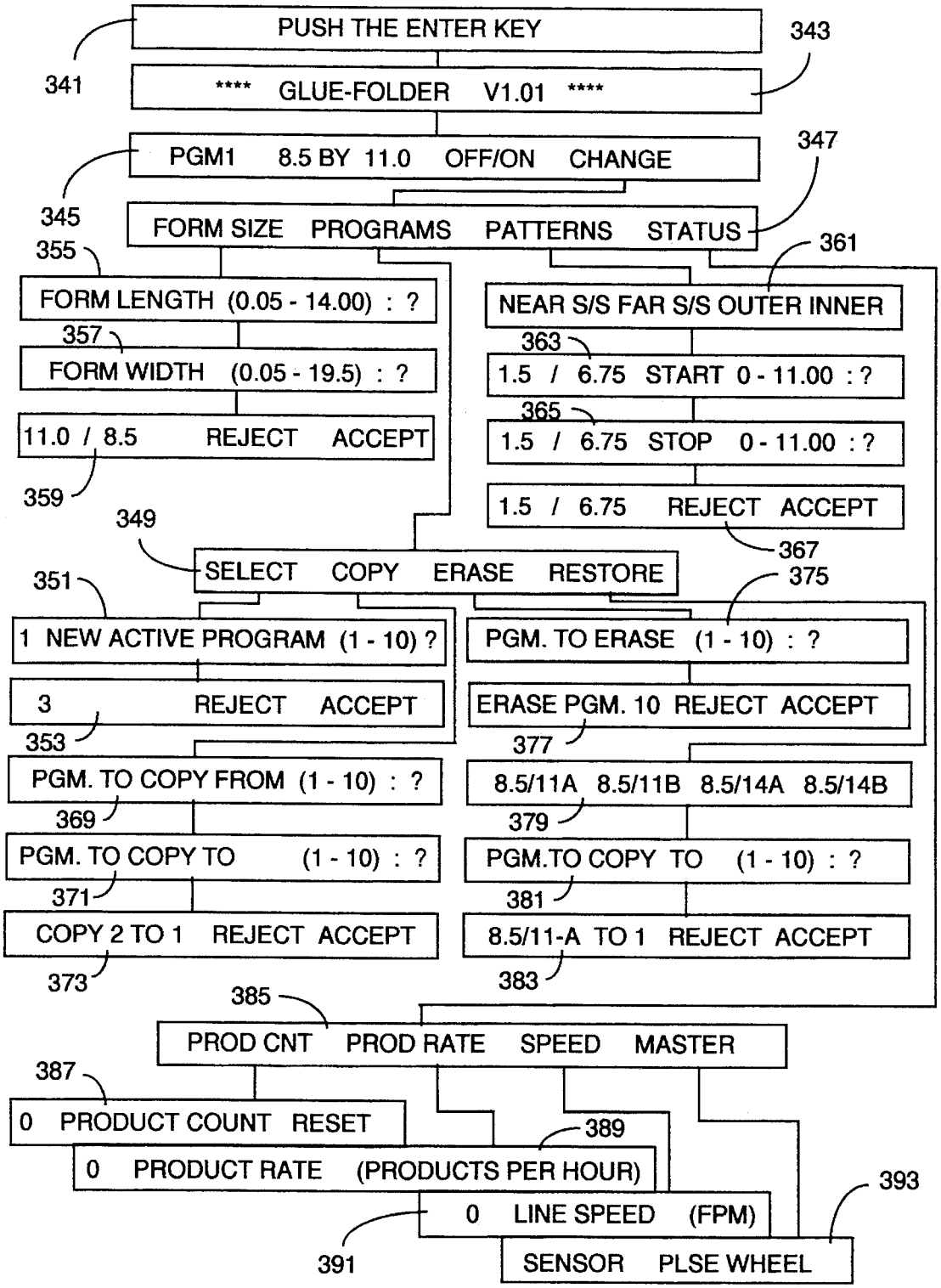
FIG. 12 is an hierarchical diagram of menus used in an operating system for the operator interface in a preferred embodiment of the invention.

FIG. 12 is a flow chart showing the hierarchy of menus provided by the operating system in the preferred embodiment. The Gluer On/Off key 295 (FIG. 11) turns the system on and enabled the control system. When key 295 is pressed the indicator light on the key lights, and message panel 297 displays "PUSH THE ENTER KEY", shown as display 341 in FIG. 12. When the Enter key is pressed (located in key pad 307), the system runs through pre-programmed checks for such as safety switches "made" and so forth, while displaying message 343 indicating the operating system version. After the checks are successfully completed the system then displays Main Menu 345 with the word "OFF" displayed. ON and OFF are status messages, and one or the other is displayed, never both. This means that the program number indicated in the message is either On or Off. The soft key under the On Off position may be used to toggle the program on and off. To continue operation from the point described above, the user pushes the soft key to turn the program On, and the display changes to indicate the new status. The program number displayed is the last program active before the computer was last switched off.

At this point in starting up, if the program number displayed is the program number the user desires to run, the following sequence (with reference to FIGS. 11 and 12) will start the machine to process a batch of sheets:

1. Load sheets in feeder tray.
2. Turn glue pressure on with key 311.
3. Turn glue heads on with keys 309.
4. Turn jam detector on with key 331.
5. Turn double sheet detector on with key 335.
6. Enable folder with Folder On/Off keys 325.
7. Adjust folder speed at knob 327 if necessary.
8. Reset counter.
9. Turn Air Feed On/Off (key 329) On.

Air Feed key 329 starts vacuum and air feed. Since it is the vacuum wheel that feeds sheets to the first set of rollers, turning on the vacuum starts the sheets to feed. One with skill in the art will understand that there are numerous adjustments that must be correctly made before the system will operate properly. The above starting sequence assumes that all such adjustments are correctly made.

Four programs shown in Table 1 are provided that may be used without alteration:

TABLE 1

| PGM. | Sheet Size | Folded in | |
|---|---|---|---|
| 1 | 8.5 × 11 | 2 | Thirds |
| 2 | 8.5 × 11 | 1 | Half |
| 3 | 8.5 × 14 | 2 | Thirds |
| 4 | 8.5 × 14 | 2 | Half* |

*Half, then half again with a ½ inch glue lip for spot gluing the 8.5 inch direction.

In the description above relative to FIG. 12, the hierarchical menu display, at the point of display 345 the system may be started with the program displayed, as described. Alternatively, a user may change the program to be run, or even create a new program, There is memory storage in the control system for storing up to ten programs.

To select a different program the user selects "Change" in display 345 (FIG. 12). The message changes to display 347. "PROGRAMS" is then selected, and the message changes to display 349, offering four selections: SELECT, COPY, ERASE, and RESTORE. To select a new program the user selects "SELECT". The message changes then to display 351. The user enters a new number from keypad 307 and presses the ENTER key. The message then changes to display 353 with the new program number displayed and choices for the user to ACCEPT or REJECT the selection. If the user selects ACCEPT, the message reverts to display 345 with the new program number and a short description displayed, and the user may now turn that program ON or OFF and run as described above, or select to change again.

Change sends the user to menu display 347 as before. The procedure from PROGRAMS has been described. If the user wants to modify a program listed in display 345 as active, there are two choices: FORM SIZE and PATTERNS. Selecting FORM SIZE produces display 355. The user may enter any length from 0.05 to 14 inches at the keypad in increments of 0.05 inches, and press ENTER. The message goes to display 357, and the user may enter any width from 0.05 to 19.5 inches in increments of 0.05 inches, and press ENTER. The message then changes to display 359, displaying the new length and width, and giving the user an opportunity to ACCEPT or REJECT.

In a similar manner, a user may select PATTERNS in display 347, which changes the message to menu display 361. The user may now select the NEAR SIDE SEAM, the FAR SIDE SEAM, the OUTER spots (the two spot gluers away from the user side of the machine), or the INNER spots. NEAR S/S and FAR S/S are selections for changing the starting point and the length of a glue stripe applied to a sheet. When a user selects one of these, the message changes to display 363.

The first number displayed in menu display 363 is the starting point and the other the stopping point along the length of a sheet, and these numbers are a function of the program active, and the sheet size for that program. Display 363 allows the user to change the glue starting point for a seam by entering a new starting point at the keypad and pressing ENTER. The message then changes to display 365 and the user may change the stopping point and ENTER. Message 367 then allows the user to ACCEPT or REJECT the new points.

Program selection among stored programs was described above. From menu display 349 a user may also COPY, ERASE, or RESTORE. Copy uses menus 369, 371, and 373, and allows the user to copy any stored program to any other program number, which erases the old program and substitutes the new. The use of these menus is as described above for other sequences, and explained by the selections shown.

To ERASE, a user selects ERASE to display menu 375, where the user may enter a program number and ACCEPT or REJECT in menu 377. The program erased leaves a null for that program number between 1 and 10. Selecting RESTORE in menu 349 allows a user to restore any one of the four original programs described to any one (or more) of the ten program numbers, using menus 379, 381, and 383, much as described for the COPY function.

From menu 347 a user may inquire of and display system status through menu 385 by selecting STATUS. The PROD. CNT selection from menu 385 produces menu 387 which displays the production count for the current job, and provides a reset for the user. The PROD RATE selection from menu 385 produces menu 389, and displays the rate.

The SPEED selection from menu 385 produces display 391, and displays the line speed in feet per minute (FPM). The MASTER selection from menu 385 produces display 393. This display is an indicator of correct operation of a revolution counter and the sensor that senses sheets fed into the system. If the machine is running, and both the pulse wheel (revolution counter) and the sensor are working correctly, the words PLSE WHEEL and SENSOR will flash at the rate the system is running. At any time in the menu selection process, a user may press the DONE key 323 (FIG. 11), which returns the message to the Main Menu shown in display 345.

FIGS. 16 A, B, C, and D show an alternative apparatus for mounting the glue guns to the mounting rail (227 in FIGS. 7, 8A, and 8B), and for affording fine adjustment of the glue guns relative to passing sheets of paper. The mounting shown by FIGS. 16A, 16B, 16C, and 16D also affords a means of quickly mounting and demounting the glue guns for such as purging and cleaning, while allowing the guns to be remounted in exactly the position they occupied before demounting.

Figure 16B:
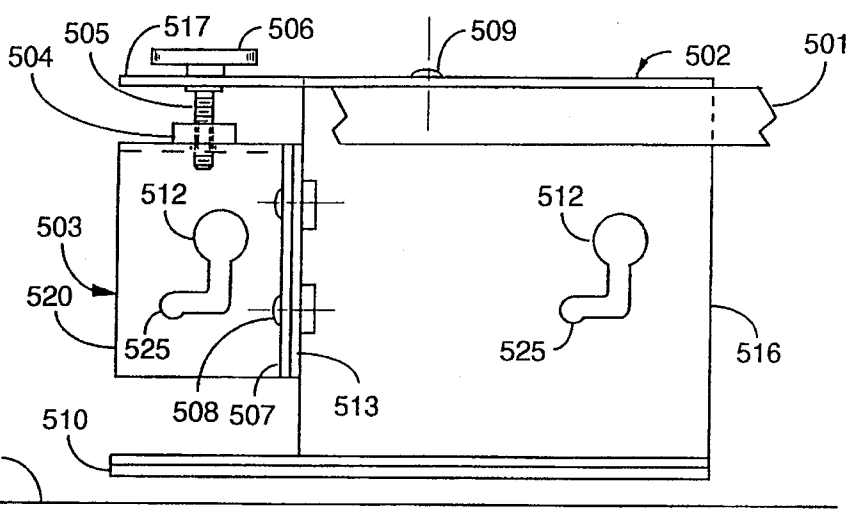
FIG. 16B is a view of the apparatus of FIG. 16A in the direction of arrow 514.
Figure 16D:
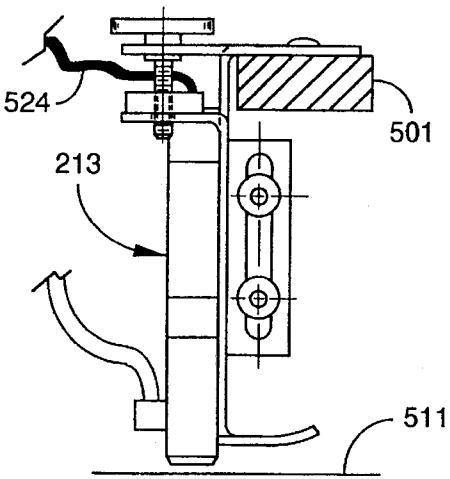
FIG. 16D is a view from the same vantage of FIG. 16A, showing a glue gun mounted to the adjusting apparatus.
Figure 16A:
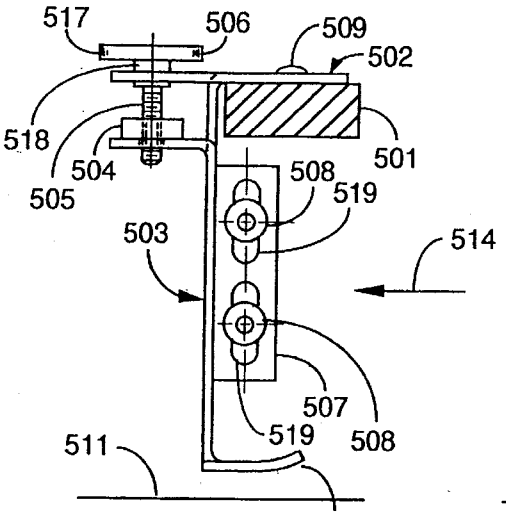
FIG. 16A is a side view of an alternative apparatus for mounting and adjusting glue guns according to an embodiment of the invention.

With reference to FIGS. 16A, B, and D, rectangular mounting rail 501 spans the paper tray area as does rail 227 in FIG. 7 and 8A, and serves tile function of rail 227 in the earlier described embodiment.

A sheet metal bracket; 502 mounts to rail 501 by means of a conventional fastener 509, which is a slotted-head screw in the present case, but may as well be ally of a number of other conventional fasteners. A slot (not shown) in bracket 502 allows adjustment of bracket 502 along the length of rail 501 before the fastener is secured.

Referring to FIG. 16B, bracket 502 has a vertically oriented portion 516 when mounted to rail 501. The vertically oriented portion ends in a foot 510 which may be welded or soldered to the body of the bracket. The vertically oriented portion also has a slotted opening 512 and a flange 513. There is, in addition, a horizontal projection 517 through which a pivot bearing 518 mounts an adjustment knob 506.

Knob 506 is fixedly attached to a screw thread 505 engaging a nut 504 welded to a secondary bracket 503. Bracket 503 has a vertically oriented portion 520 in assembly which is coplanar with vertically oriented portion 516 of bracket 502. Portion 520 has a second slotted opening 512. There is also a flange portion 507 which matches flange portion 513 of bracket 502. Two fasteners 508 urge the flange portions of the two brackets together through slots 519, such that there may be sliding contact between the flange portions.

Bracket 502 is fixedly attached to rail 501, so when adjusting knob 506 is turned, bracket 503 is raised or lowered relative to bracket 502.

Figure 16C:
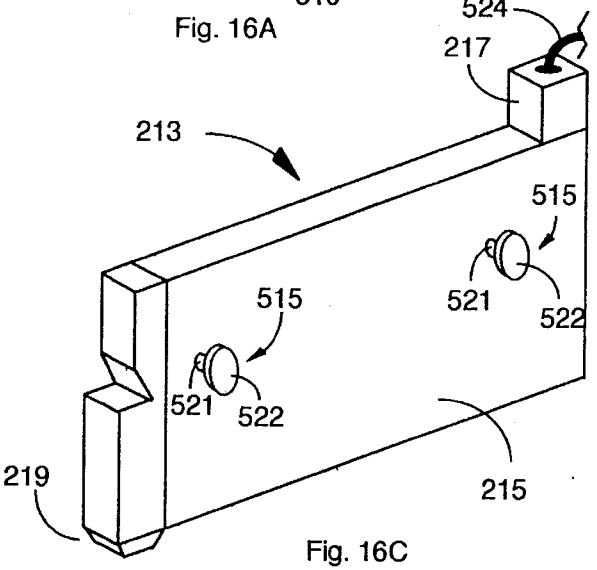
FIG. 16C is an isometric view of a glue gun with pins for mounting to the apparatus of FIGS. 16A and 16B.

FIG. 16C is an isometric view of a glue gun 213 wherein mounting pins 515 are fixed in body 215 for mounting gun 213 to the apparatus of FIG. 16A and 16B. Solenoid 217 and gluing tip 219 are also shown in FIG. 16C, and have the same functions as those of the same element numbers shown in FIG. 6A.

Mounting pins 515 are fixedly attached to body 215 of glue gun 213, such as by threads with a shoulder. Other means of fastening may be used. Pins 515 also each have a shaft portion 521 and a larger diameter head portion 522.

FIG. 16C shows a gun 213 mounted to brackets 502 and 503, from the same vantage as FIG. 16A. Mounting is simply by placing the enlarged head portions 522 of the mounting pins attached to the body of the glue gun through the larger opening of the slotted openings 512, and moving the guns downward and to one side until the pins register in depressed portions 525 of the slotted openings.

Flexible power and control electrical line 524 and flexible glue supply line 523 allows freedom of movement so guns may be easily and quickly demounted and remounted without losing adjustment, for such as purging and cleaning.

There are a variety of details that may be altered without departing form the spirit and scope of the invention as depicted in FIG. 16A, B, C, and D. For example, the threaded adjusting mechanism for moving one bracket, carrying one mounting pin of a glue gun, relative to the stationary bracket, carrying the other mounting pin, may be accomplished in a variety of equivalent ways. Similarly, the slotted openings are convenient in the geometry shown, but there are other geometries that will work as well. The important features are that one end of the gun, that end where the glue nozzle is located, may be raised and lowered by raising and lowering the mounting pin of the gun relative to the other mounting pin, which acts as a pivot, retained in the stationary bracket.

Figure 17:
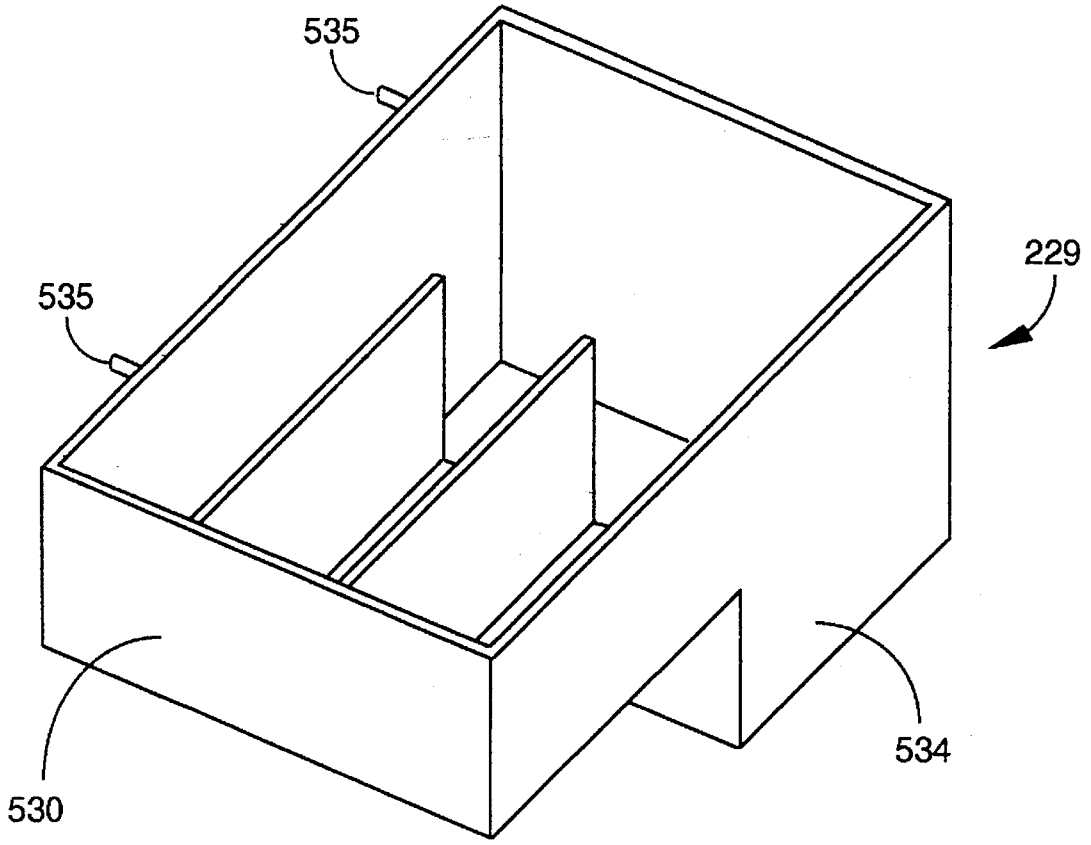
FIG. 17 is an isometric view of a purge and cleaning apparatus also shown in FIG. 2.

FIG. 17 is an isometric view of purge and cleaning apparatus 229 shown in plan view in FIG. 7. This apparatus comprises a shelf area 530 having three separated shelves 531, 532, and 533. There is also a deeper receptacle area 534. Apparatus 229 has mounting pins 535 such that the apparatus may be easily and quickly mounted to and demounted from the frame of the self-mailer machine.

The glue guns, mounted as described above relative to FIGS. 16A, B, C, and D, when demounted from the adjustable brackets at the end of the paper tray, by virtue of the flexible service lines to each of the guns, may be placed in the separated shelves with the gluing tip of each over tray area 534. In this position, the guns may be operated to purge the lines of glue, and even to pass cleaning solution through the lines and the guns. When service procedures are completed, the guns may again be easily and quickly remounted in their operating positions as shown above.

When the guns are remounted in the operating position, the cleaning apparatus 229 may be removed from the machine frame and taken away to dispose of waste material and to clean the tray and shelf areas.

Glue guns mounted in assembly 249 (FIG. 2) also have flexible lines for power, control, and glue, and assembly 249 may be lifted from the folding plate as a unit and placed on apparatus 229 for purging and cleaning of the guns used to apply the glue spots along a fold line as described above in the section titled "Gluing Subsystem".

It will be apparent to a worker with skill in the art that there are a very wide variety of changes that might be made in the embodiments described herein without departing from the spirit and scope of the invention. For example, while a particular folder from a particular manufacturer is used in the preferred embodiment, other folders would be useful as long as they meet the requirement for vacuum interface to the paper described for the folder used. There are similarly many ways that the mechanisms described might be implemented without departing from the invention. One might, for example, change the angles of folding plates, the size of trays and other elements, and much more.

What is claimed is:

1. An apparatus for producing self-mailers from sheets comprising:

a folding machine for feeding the sheets along a paper path from a stack of sheets in a supply tray and for folding each sheet into folded form for a self-mailer;

a mounting frame member attached to the folding machine at a position over the paper path from the supply tray into the folding machine;

at least one solenoid-operated glue gun adapted to mount to the mounting frame member, the glue gun having a dispensing tip positionable when mounted to apply glue to a passing sheet, the glue gun connected to power, control, and glue supply by flexible tethers; and a purging and cleaning apparatus having a holder for the glue gun and a receptacle for receiving matter dispensed by the glue gun, the purging and cleaning apparatus placed at a position apart from and nowhere above the paper path;

wherein, during purging and cleaning operations, the glue gun may be removed from the application position over the paper path, and placed in the purging and cleaning apparatus, where effluent from the glue gun during purging and cleaning operations cannot fall into the folding machine.

2. An apparatus for producing self-mailers as in claim 1 further comprising a microprocessor-based controller for managing operations and for providing an operator interface for entering control variables and displaying information.

3. An apparatus as in claim 1 comprising two solenoid-operated glue guns mountable to dispense glue along opposite edges of a passing sheet, each of the glue guns having tethers of sufficient length that either or both may be mounted to the mounting frame member for operation to make self-mailers, or placed in the holder at the purging and cleaning apparatus for purging and cleaning operations.

4. An apparatus as in claim 1 wherein the glue is fed from a pressurizable glue reservoir through a dispenser connected to the glue gun by conduit and the flexible tethers.

5. An apparatus as in claim 4 wherein individual presurizable glue reservoirs have a perforatable seal which is punctured when mounting a the dispenser to the container.

6. An apparatus as in claim 3 further comprising a plurality of solenoid-operated glue guns mounted in a unit across a folding plate of the folding machine, and operable to place glue dots along a folded edge of a sheet feeding through the folding machine, the plurality of glue guns in the unit having second flexible tethers of sufficient length that the unit may be mounted across the folding plate for operation to make self-mailers, or placed in the holder at the purging and cleaning apparatus for purging and cleaning operations.

7. An apparatus as in claim 1 comprising a mounting cradle attached to the mounting frame member, the mounting cradle for holding the at least one glue gun, a portion of the mounting cradle being vertically adjustable to raise and lower the dispensing head of the mounted glue gun to adjust the height of the dispensing head over the plane of a passing sheet.

8. An apparatus as in claim 7 wherein the mounting cradle comprises two brackets attached to the mounting frame member, one fixedly attached to the mounting frame member and the other vertically adjustable, each bracket having a slot for engaging a pin on the at least one glue gun, the slots configured to allow the guns to be mounted and demounted by placing the pins through an opening of the slots, and moving the guns to an engaged position.

* * * * *